US007970293B2

(12) United States Patent
Ishikawa et al.

(10) Patent No.: US 7,970,293 B2
(45) Date of Patent: Jun. 28, 2011

(54) METHODS AND SYSTEMS RELATING TO IMAGE FORMING APPARATUSES

(75) Inventors: Satoru Ishikawa, Kitanagoya (JP); Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 490 days.

(21) Appl. No.: 12/039,277

(22) Filed: Feb. 28, 2008

(65) Prior Publication Data

US 2008/0205911 A1 Aug. 28, 2008

(30) Foreign Application Priority Data

Feb. 28, 2007 (JP) ..... 2007-050724
Feb. 28, 2007 (JP) ..... 2007-050725
Aug. 30, 2007 (JP) ..... 2007-224187

(51) Int. Cl.
*G03G 15/00* (2006.01)
*G03G 15/04* (2006.01)

(52) U.S. Cl. ..... 399/12; 399/24; 399/25; 399/75; 399/119

(58) Field of Classification Search ..... 399/12, 399/24, 25, 75, 119
See application file for complete search history.

(56) References Cited

U.S. PATENT DOCUMENTS 5,038,173 A * 8/1991 Kusumoto ..... 399/13
7,496,299 B2 * 2/2009 Aratachi ..... 399/12
7,512,347 B2 * 3/2009 Suzuki et al. ..... 399/12
7,756,426 B2 * 7/2010 Kamimura ..... 399/12
2006/0034625 A1 * 2/2006 Kajikawa ..... 399/12
2006/0034627 A1 * 2/2006 Kikuchi et al. ..... 399/24
2006/0193643 A1 * 8/2006 Takagi et al. ..... 399/12
2006/0193645 A1 8/2006 Kishi
2006/0193646 A1 8/2006 Suzuki et al.
2007/0122165 A1 * 5/2007 Igarashi et al. ..... 399/12

FOREIGN PATENT DOCUMENTS

JP H05-165323 A 7/1993
JP H06-258910 A 9/1994
JP 2003-316227 A 11/2003
JP 2005180962 A 7/2005
JP 2006-162946 A 6/2006
JP 2006243071 A 9/2006
JP 2006267994 A 10/2006

OTHER PUBLICATIONS

Japan Patent Office, Notice of Reasons for Rejection for Japanese Patent Application No. 2007-050725 (counterpart to above-captioned patent application), mailed Jul. 13, 2010.

* cited by examiner

*Primary Examiner* — David M Gray
*Assistant Examiner* — Francis Gray
(74) *Attorney, Agent, or Firm* — Baker Botts L.L.P.

(57) ABSTRACT

The invention describes an image forming apparatus having a cartridge configured to be removably attached to a main body. The cartridge has a rotational body positioned within the cartridge and an extension portion protruding outward from the rotational body in an axial direction. The device body has a main body, which has a driving member that rotates the rotational body and the extension portion, a detecting unit for detecting a movement of the extension portion, and a determining unit for determining a type of the developer cartridge using either a time elapsed between a time in which the driving member begins driving the rotational body and a time in which the detecting unit detects the movement of the extension portion, or a drive amount of the drive device occurring during an elapsed time.

8 Claims, 21 Drawing Sheets

REAR ⟷ FRONT

| EXTENSION PORTION MOVING TIME | $\alpha$ | $\beta$ |
|---|---|---|
| TYPE | FOR 3000 SHEETS | FOR 6000 SHEETS |

208

METHODS AND SYSTEMS RELATING TO IMAGE FORMING APPARATUSES

CROSS REFERENCE TO RELATED APPLICATION

This application claims priority from Japanese Patent Application No. 2007-050724, filed on Feb. 28, 2007, Japanese Patent Application No. 2007-050725, filed on Feb. 28, 2007 and Japanese Patent Application No. 2007-224187, filed on Aug. 30, 2007, the disclosures of which are herein incorporated by reference in their entirety.

BACKGROUND OF THE INVENTION

1. Field of the Invention

The invention relates generally to an image forming apparatus configured to check the condition of a developer cartridge installed therein.

2. Description of Related Art

A known developer cartridge may be configured to store toner therein, to be selectively attached to and detached from a known image forming apparatus, such as a laser printer. The known image forming apparatus may be configured to determine a condition of the installed developer cartridge, i.e., whether an installed developer cartridge is a new cartridge or a used cartridge, and to determine a type of the installed developer cartridge.

The known image forming apparatus includes a swingable arm-like actuator, a spring which urges the actuator toward a first position, a sensor configured to detect the swing of the actuator, and a controller configured to determine the condition of the developer cartridge and to determine the type of developer cartridge based on signals outputted from the sensor. The known developer cartridge includes one or two contact protrusions which protrude from a shaft portion, a detection gear configured to rotate about the shaft portion together with the contact protrusion(s), and a gear mechanism configured to engage the detection gear and to transmit a driving force to a developing roller.

For example, when a front cover of the image forming apparatus is closed after the developer cartridge is attached to the main body of the image forming apparatus, the controller performs a warm-up operation including an idle rotation. During the idle rotation, an agitator rotates to agitate toner stored in the developer cartridge.

A transmission force from a drive source, which is provided at the main body of the image forming apparatus, is transmitted to the agitator and to the detection gear, which are provided at the developer cartridge, via the gear mechanism, to perform the idle rotation. By the transmission of the force, the agitator starts the agitation of the toner and the contact protrusion further moves and applies the force to the first end of the actuator, and thus, the contact protrusion disengages from the actuator at a second position. Subsequently, the actuator returns to the first position due to the urging force from the spring. When the developer cartridge includes two contact protrusions, a first of the contact protrusions applies the force to the first end of the actuator, and a second of the contact protrusions then applies a force to the first end of the actuator to further swing the actuator. The second swing of the actuator is detected by the sensor, and a signal detected by the sensor is transmitted to the controller as a second detection signal.

If, however, a user inadvertently rotates the developing roller or a gear positioned in the gear mechanism or the known developer cartridge, the detection gear may rotate in synchronization with the gear mechanism, and the contact protrusion(s) may move to an undesired position(s). Then, the actuator and the sensor may not correctly detect the contact protrusion(s).

SUMMARY OF THE INVENTION

An image forming apparatus comprising a cartridge configured to be removably attached to a main body, wherein the cartridge is configured to be in one of a new state or a used state, the cartridge comprising a rotational body positioned within the cartridge, and comprising an extension portion which is positioned offset from a center of the rotational body and configured to protrude outward from the rotational body in an axial direction, wherein the rotational body and the extension portion are configured to selectively be positioned in one of a first state and a second state, and a device body comprising the main body, the main body comprising a driving member configured to rotate the rotational body, a detecting unit configured to detect a movement of the extension portion between the first state to the second state, and a determining unit configured to receive a signal from the detecting unit when the extension portion moves between the first state and the second state, wherein the determining unit calculates an elapsed time between when the driving member starts driving and when the determining unit receives the signal from the detecting unit, wherein the determining unit is configured to determine whether the cartridge is in the new state or the used state, and to determine a type of the cartridge, based on the elapsed time.

In another embodiment of the invention, a method for determining a type of cartridge comprises the steps of receiving a cartridge into a main body of an image forming apparatus, wherein the cartridge is in a first state or a second state, determining a position of a contact member of the image forming apparatus when the cartridge is received into the main body, wherein the contact member contacts an extension portion of a rotational body of the cartridge when the cartridge is in the first state, and the extension portion is positioned offset from a center of the rotational body, and extends axially outward away from the rotational body, engaging the rotational body of the cartridge with a driving member configured to rotate the rotational body, detecting whether the position of the contact member changes when the cartridge is received into the main body of the image forming apparatus, detecting a movement of the contact member when the driving member drives the rotational body of the cartridge, determining whether the cartridge is in the first state or the second state, measuring a number of rotations of the driving member occurring between detecting the position of the contact member and detecting the second movement, and determining the type of the cartridge based on the measured number of rotations.

In still another embodiment of the invention, an image forming apparatus comprises a cartridge configured to be removably attached to a main body. The cartridge comprises a rotational body positioned within the cartridge, an extension portion positioned offset from a center of the rotational body and configured to protrude outward from the rotational body in an axial direction. A device body comprises the main body, which comprises a driving member configured to rotate the rotational body and the extension portion, a detecting unit configured to detect a movement of the extension portion and a determining unit configured to determine a type of the developer cartridge in accordance with an amount of drive of the driving member occurring during a time elapsed between a time in which the driving member begins driving the rotational body and a time in which the detecting unit detects the movement of the extension portion.

Other objects, features, and advantages will be apparent to persons of ordinary skill in the art from the following detailed description and the accompanying drawings.

BRIEF DESCRIPTION OF THE DRAWINGS

For a more complete understanding of the invention, the needs satisfied thereby, and the objects, features, and advantages thereof, reference now is made to the following description taken in connection with the accompanying drawings.

DETAILED DESCRIPTION OF PREFERRED EMBODIMENTS

Embodiments of the present invention and their features and technical advantages may be understood by referring to FIGS. 1-19C, like numerals being used for like corresponding portions in the various drawings.

Figure 1:
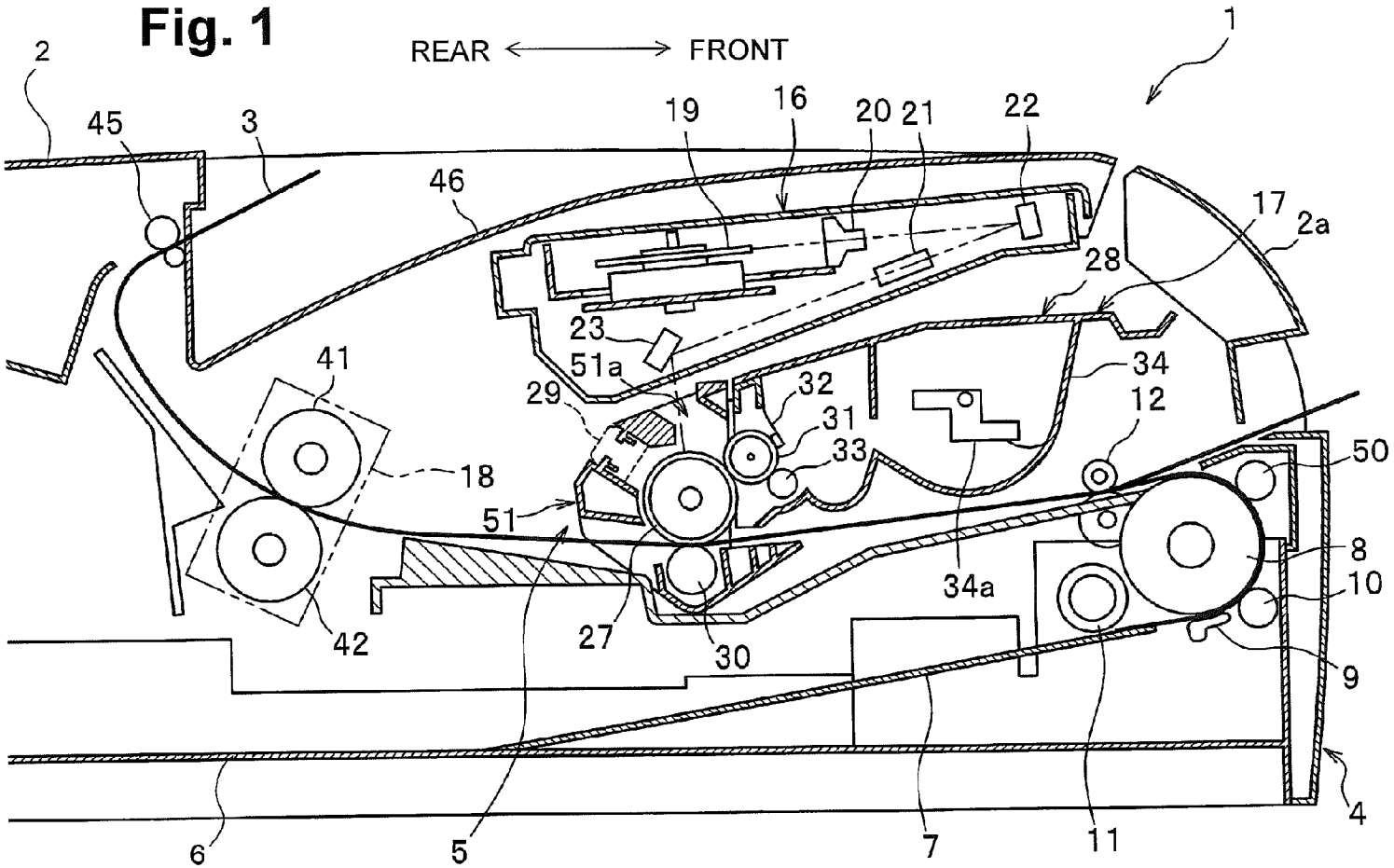
FIG. 1 is a side, cross-sectional view of a laser printer, according to an embodiment of the invention.

Referring to FIG. 1, an image forming apparatus, e.g., a laser printer 1, a copy machine, a multi-function device, or the like, may comprise a main body, e.g., a body casing 2, a feeder unit 4 configured to feed a sheet 3 to the body casing 2, and an image forming unit 5 configured to form an image onto the fed sheet 3. The body casing 2 may comprise a front cover 2*a* configured to be openable at a side, e.g., a front side.

The feeder unit 4 may comprise a sheet supply tray 6 and a sheet pressing plate 7. The sheet supply tray 6 may be configured to be detachably attached to a bottom portion of the body casing 2. The sheet pressing plate 7 may be positioned in the sheet supply tray 6. The feeder unit 4 further may comprise a feed roller 11, a supply roller 8, a supply pad 9, a pinch roller 10, and a sheet dust removing roller 50. The feed roller 11 may be positioned above a first end of the sheet supply tray 6. The supply roller 8, the supply pad 9, the pinch roller 10, and the sheet dust removing roller 50 may be positioned downstream from the feed roller 11, with respect to a conveying direction of the sheet 3. The feeder unit 4 further may comprise a register roller 12 which may be positioned downstream from the sheet dust removing roller 50 in the sheet conveying direction.

A plurality of sheets 3 may be stacked in the sheet supply tray 6. The sheets 3, which may be placed on the sheet supply tray 6, may be supplied toward the feed roller 11 by the sheet pressing plate 11. The sheets 3 then may be fed between the supply roller 8 and the supply pad 9 by the feed roller 11. A topmost sheet 3 in the stack then is supplied and is conveyed, one by one, by the supply roller 8 and the supply pad 9, to the image forming unit 5 by passing through the pinch roller 10, the sheet dust removing roller 50, and the resist roller 12.

The image forming unit 5 may comprise a scanner unit 16, a process cartridge 17, and a fixing unit 18. The scanner unit 16 may be positioned at an upper portion of the body casing 2. The scanner unit 16 may comprise a laser emitting portion (not shown), a rotatable polygon mirror 19, lenses 20 and 21, and reflectors 22 and 23. A laser emitting portion may emit a laser beam, indicated by a double dot and dashed line in FIG. 1, based on image data. The laser beam may pass through or may be reflected off of the polygon mirror 19, the lens 20, the reflector 22, the lens 21, and the reflector 23 in this order. The laser beam then may be irradiated onto a surface of a photosensitive drum 27 of the process cartridge 17, during a high-speed scanning process.

The process cartridge 17 may be configured to be detachably attached to the body casing 2, by which the front cover 2*a* may be opened. The process cartridge 17 may comprise a cartridge, e.g., a developer cartridge 28, and a drum unit 51. The developer cartridge 28 may be configured to be detachably attached to the body casing 2 via the drum unit 51, which may be fixed to body casing 2. The attachment and detachment of the developer cartridge 28 with respect to the body casing 2 may be implemented by the developer cartridge 28 alone, i.e., the drum unit 51 may remain in the body casing 2, or by the process cartridge 17, which may include the developer cartridge 28 engaged with the drum unit 51.

The developer cartridge 28 may comprise a developing roller 31, a layer-thickness regulating blade 32, a toner supply roller 33, a toner hopper 34, and an agitator 34*a*. Agitator 34*a* may agitate toner stored in the toner hopper 34. Toner supply roller 33 then may supply toner 34 onto the developing roller 31. The toner then may be positively charged due to friction between the toner supply roller 33 and the developing roller 31. The toner supplied onto the developing roller 31 then may be provided between the layer-thickness regulating blade 32 and the developing roller 31 by the rotation of the developing roller 31, and may become a thin layer, of substantially uniform thickness, on the developing roller 31.

The drum unit 51 may comprise the photosensitive drum 27, a scorotron changer 29, and a transfer roller 30. The photosensitive drum 27 is rotatably supported by a housing of the drum unit 51. The photosensitive drum 27 may comprise a drum body which is connected to a ground. The drum body comprises a positively-charged photosensitive layer on its surface. The drum unit 51 may comprise an opening formed in the housing of the drum unit 51, e.g., an exposure window 51*a*. The drum unit 51 may be positioned such that the exposure window 51*a* is located above the photosensitive drum 27.

The scorotron charger 29 may be diagonally positioned above the photosensitive drum 27, e.g., above and behind the photosensitive drum 27. Referring to FIG. 1, scorotron charge 29 may be positioned such that there is a predetermined distance between the scorotron charger 29 and the photosensitive drum 27. The scorotron charger 29 is an electrifier that generates corona discharge from, e.g., a tungsten charging wire, in order to substantially uniformly positively charge the surface of the photosensitive drum 27.

The transfer roller 30 may be positioned under the photosensitive drum 27, and may be configured to contact photosensitive drum 27. The transfer roller 30 may be rotatably supported by the housing of the drum unit 51. The transfer roller 30 may comprise a roller shaft comprising metal, and a roller portion covered with a conductive rubber material. A constant-current control (not shown) may apply a transfer bias to the transfer roller 30 during transfer. After the scorotron charger 29 may uniformly positively charge the surface of the photosensitive drum 27, the surface of the photosensitive drum 27 may be exposed to the laser beam emitted from the scanner unit 16 by the high-speed scanning process, which may form an electrostatic latent image on the surface of the photosensitive drum 27. This electrostatic latent image may be based on predetermined image data.

Then, when the formed electrostatic latent image on the surface of the photosensitive drum 27 faces and contacts the developing roller 31, the positively charged toner held on the developing roller 31 may be supplied onto and held on portions of the surface of photosensitive drum 27 corresponding to the image formed by the electrostatic latent image. Specifically, the image formed on the photosensitive drum 21, i.e., a portion of the surface of the photosensitive drum 27 that the laser beam emitted by the scanner unit 16 exposed, e.g., the portion corresponding to the formed electrostatic latent image, may have a lower electric potential than those portions which may not have been exposed by the laser beam of the photosensitive drum 27. Thus, exposure by the laser beam may lower the electric potential of the photosensitive drum.

Thus, the electrostatic latent image formed on the photosensitive drum 27 may be visualized when the generally positively charged toner adheres to the portion of the surface of the photosensitive drum 21 that has a lower electric potential, e.g., the portion corresponding to the image. Subsequently, the photosensitive drum 27 and the transfer roller 30 may rotate to convey the sheet 3, while pinching the sheet 3 therebetween. With this operation, the toner image held on the surface of the photosensitive drum 27 may be transferred onto the sheet 3.

The process cartridge 17 may be attached to the body casing 2 such that the fixing unit 18 may be positioned downstream of the process cartridge 17 in the sheet conveying direction. The fixing unit 18 may comprise a heat roller 41 and a pressing roller 42. The pressing roller 42 faces and applies a force to the heat roller 41. At the fixing unit 18, the toner transferred onto the sheet 3 may be thermally fixed onto the sheet 3 while the sheet 3 passes between the heat roller 41 and the pressing roller 42. The sheet 3, on which the toner has been fixed, further may be conveyed to a discharge roller 45, which may be positioned downstream from the fixing unit 18 in the sheet conveying direction. The sheet 3 then may be discharged onto a sheet discharge tray 46 by the discharge roller 45.

Figure 2:
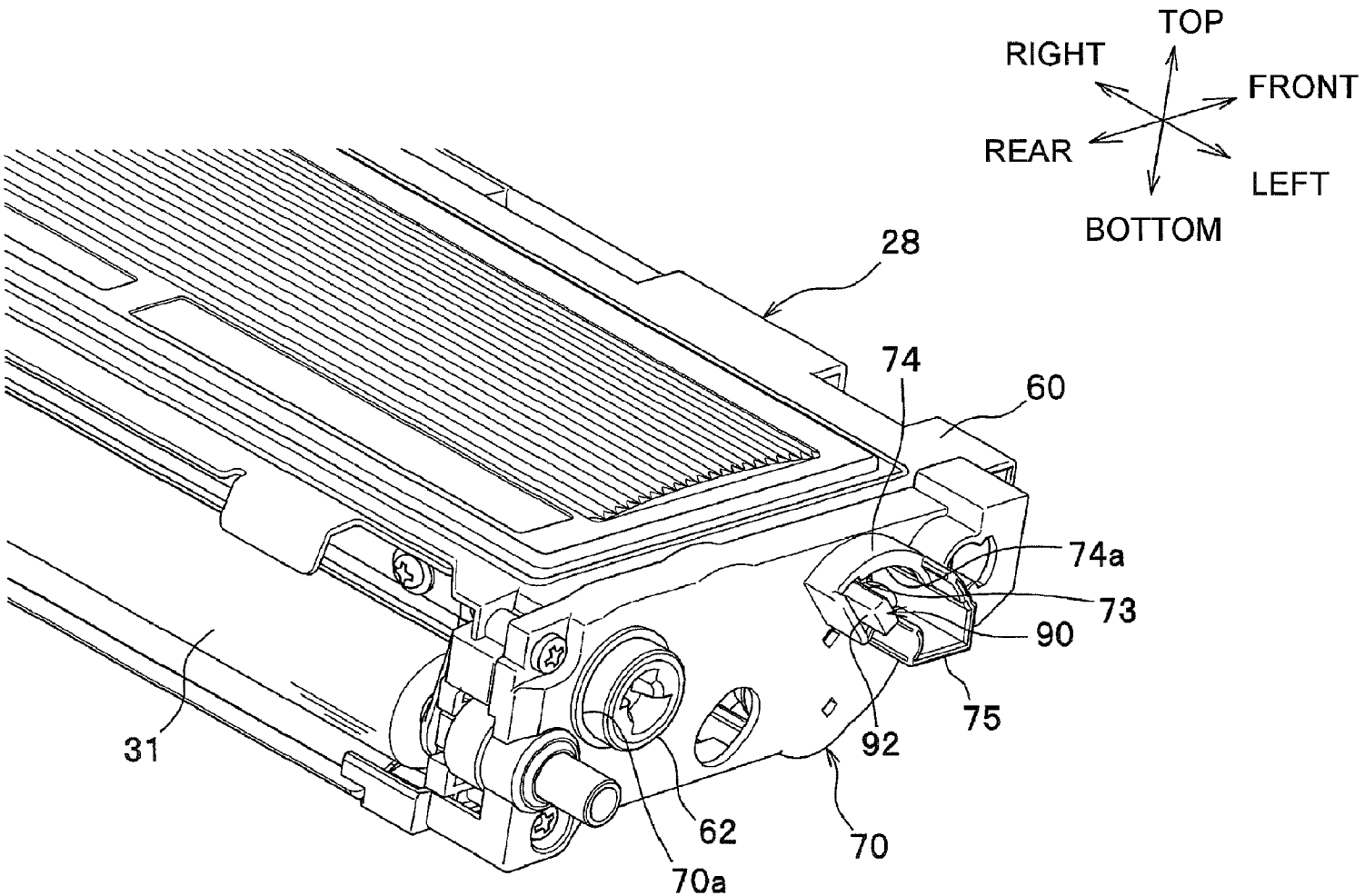
FIG. 2 is a perspective view of a developer cartridge, in which the developer cartridge is configured to be installed in the laser printer of FIG. 1, and in which the developer cartridge is configured to contain developer for forming images on 3000 sheets, according to an embodiment of the invention.
Figure 3:
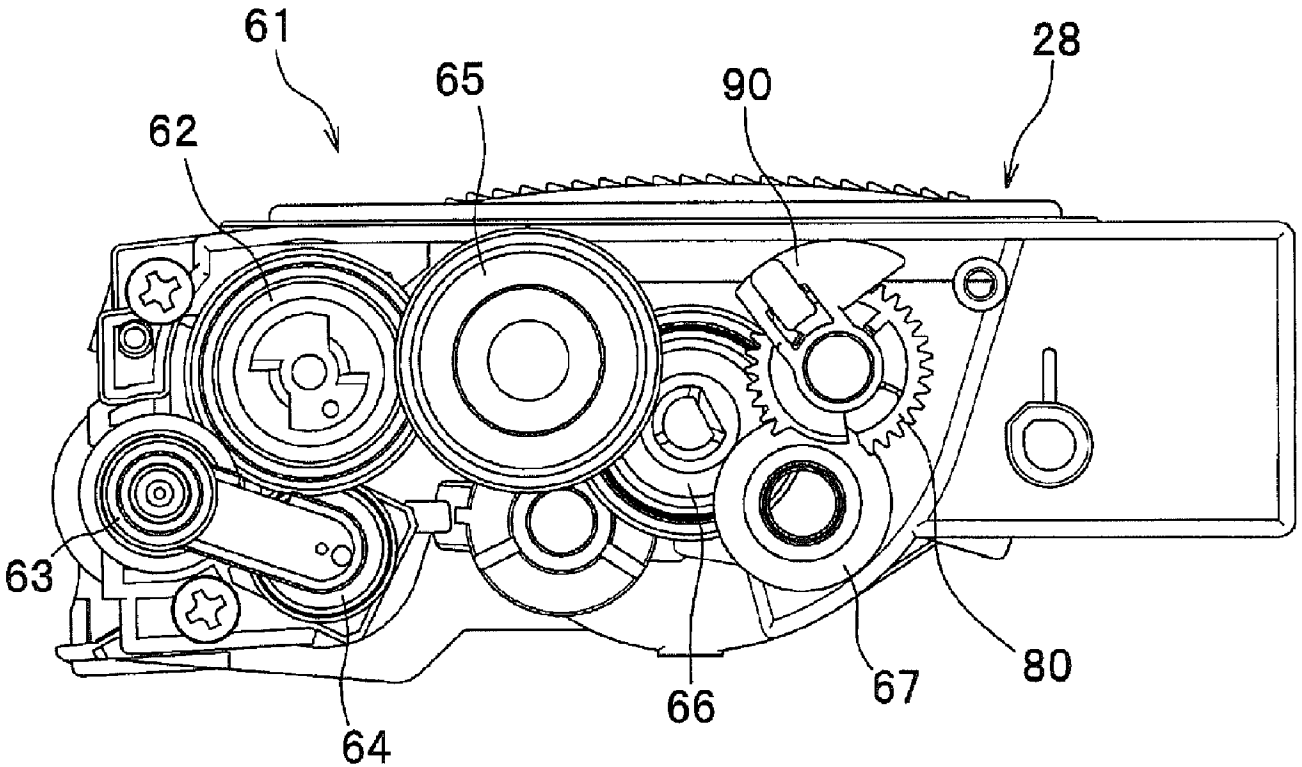
FIG. 3 is a left side view of the developer cartridge of FIG. 2, in which a cover member is omitted.

Referring to FIG. 2, the developer cartridge 28 may comprise the developing roller 31, an inner housing, e.g., a cartridge body 60, and a cover member 70. The cover member 70 may be configured to be detachably attached to a side, e.g., a left side, of the cartridge body 60. Referring to FIG. 3, the developer cartridge 28 may comprise a gear mechanism 61, an engagement gear 80, and a rotational body 90, positioned between the cartridge body 60 and the cover member 70. The gear mechanism 61 may be configured to transmit a drive force to the developing roller 31. The engagement gear 80 and the rotational body 90 may be configured to be nonreversibly rotatable in one direction. The rotational body 90 may comprise a gear configured to be rotatable by receiving a force from the engagement gear 80.

Figure 6:
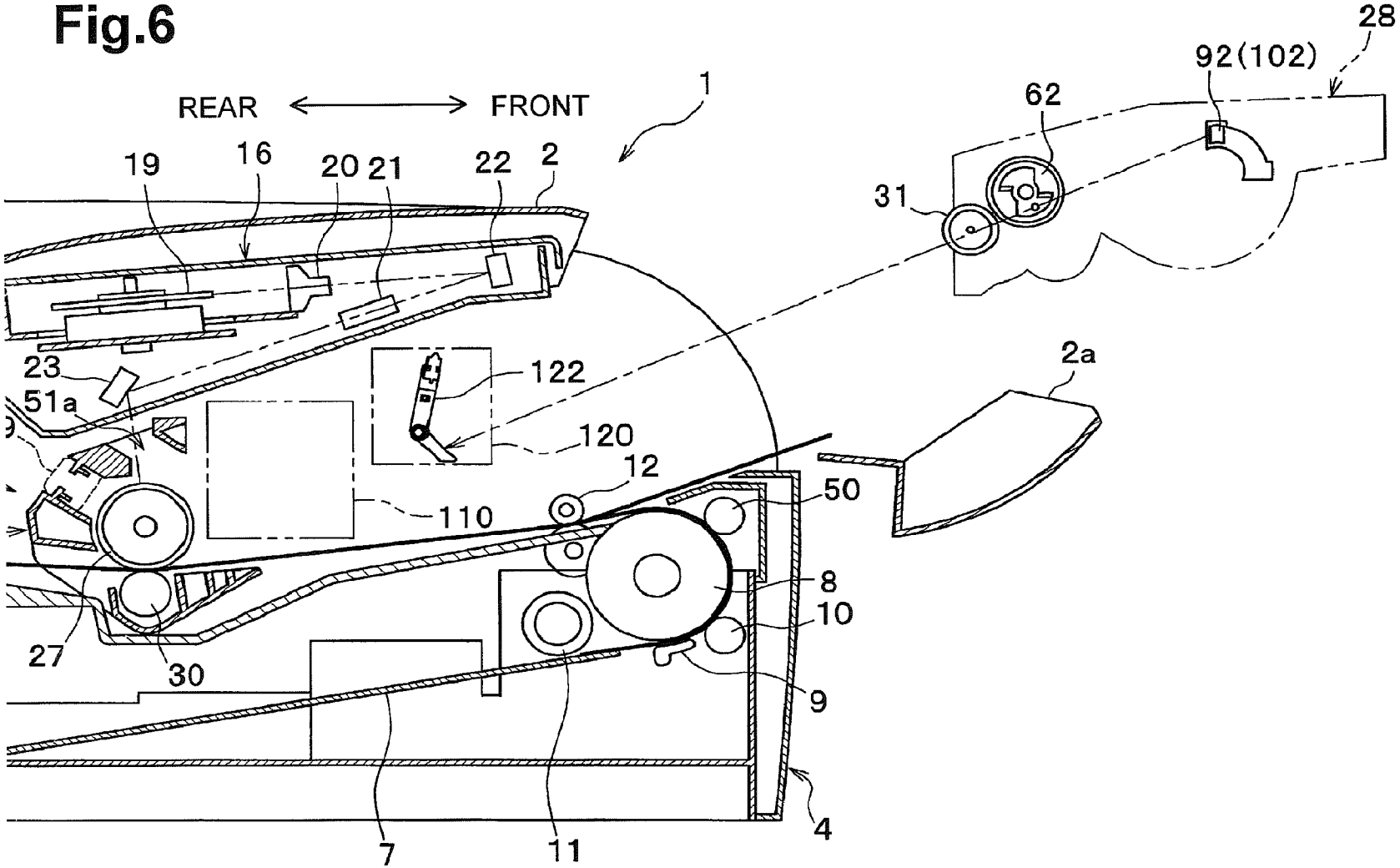
FIG. 6 is a side, cross-sectional view of the laser printer of FIG. 1, in which the developer cartridge is separated from a body casing of the laser printer.

Referring to FIGS. 3 and 6, the gear mechanism 61 may comprise an input gear 62, a developing roller drive gear 63, a toner supply roller drive gear 64, an agitator drive gear 66, and a transmission gear 67. A drive device 110, positioned in the body casing 2, may transmit a drive force to the input gear 62. The developing roller drive gear 63 and the toner supply roller drive gear 64 may be configured to directly engage the input gear 62. The agitator drive gear 66 may be configured to engage the input gear 62 via an intermediate gear 65. The transmission gear 67 may be configured to directly engage the agitator drive gear 66. Referring back to FIG. 1, the developing roller drive gear 63, the toner supply roller drive gear 64, and the agitator drive gear 66 may be configured to drive the developing roller 31, the toner supply roller 33, and the agitator 34*a*, respectively, and may be integral with respective ends of shafts of the developing roller 31, the toner supply roller 33, and the agitator 34*a*.

Figure 4A:
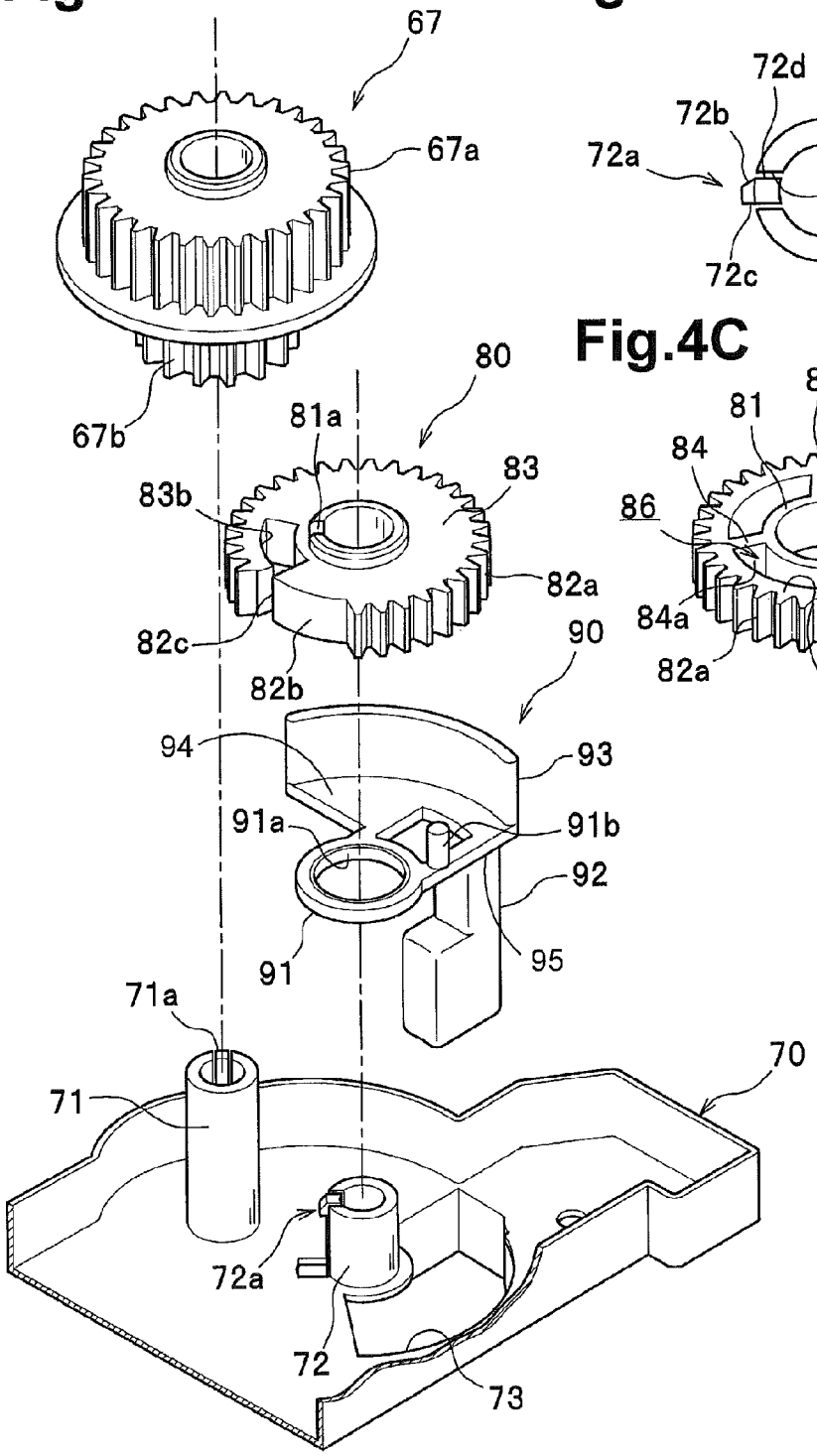
FIG. 4A is an enlarged, right side, perspective view of a cover member and a gear mechanism of the developer cartridge of FIG. 2, when viewed from the inside of the developer cartridge of FIG. 2, according to an embodiment of the invention.

Referring again to FIG. 3, the transmission gear 67 may comprise a reduction gear configured to reduce the speed of rotation of the engagement gear 80. Referring to FIG. 4A, the transmission gear 67 may comprise a larger-diameter gear portion 67*a* and a smaller-diameter gear portion 67*b*. The larger-diameter gear portion 67*a* may be configured to engage the agitator drive gear 66. The smaller-diameter gear portion 67*b* comprises a diameter which may be less than the larger-diameter gear portion 67*a*, and may be configured to engage the engagement gear 80. The transmission gear 67 may be rotatably supported by a first cylindrical support shaft portion 71, which may be provided on an inner surface of the cover member 70. A portion of the first support shaft portion 71 may comprise a hook-like retaining portion 71*a*. Hook-like retaining portion 71*a* may be configured to be deformable in a diameter direction of the first support shaft portion 71, and to retain the transmission gear 67 in the first support shaft portion 71.

Figure 4B:
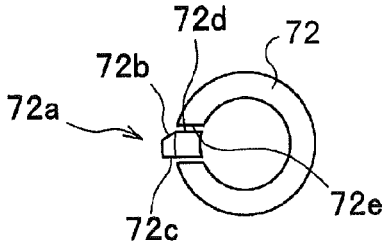
FIG. 4B is a right side, plan view of an engaging portion of a second support shaft portion on the cover member.
Figure 4C:
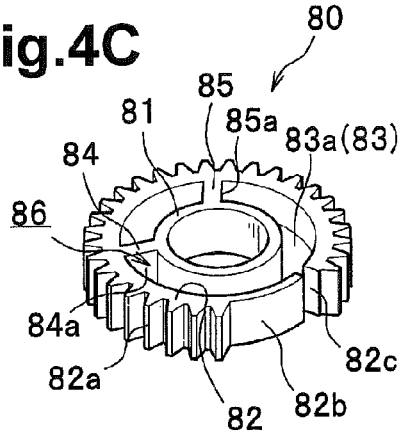
FIG. 4C is a left side, perspective view of a left side of the gear mechanism of FIG. 4A.

Referring to FIG. 4C, the engagement gear 80 may comprise an inner cylindrical portion 81, an outer cylindrical portion 82 which may have a diameter greater than the inner cylindrical portion 81, and a connection wall 83 which may connect edges of the inner cylindrical portion 81 to the outer cylindrical portion 82. The inner cylindrical portion 81 of the engagement gear 80 may be rotatably supported by a shaft portion, e.g., a second cylindrical support shaft portion 72, which may be positioned on the inner surface of the cover member 70. The inner cylindrical portion 81 may comprise an engaging groove 81*a* at first end opposite a second end facing the cover member 70. The engaging groove 81*a* may be configured to engage an engaging portion 72*a*, which may be positioned at a tip of the second support shaft portion 72. Engaging portion 72*a* and the engaging groove 81*a* may be positioned in alignment with respect to the cover member 70 and the engagement gear 80.

The engaging portion 72*a* may be deformable in a diameter direction of the second support shaft portion 72. A tip of the engaging portion 72*a* may comprise a hook-like portion protruding outwardly in the diameter direction of the second support shaft portion 72. Referring to FIG. 4B, the hook-like tip portion of the engaging portion 72*a* may comprise a first contact surface 72*b* and a second contact surface 72*c*. The first contact surface 72*b* may be inclined with respect to the diameter direction of the second support shaft portion 72, and may contact a wall of the engaging groove 81*a* of the engagement gear 80, in a rotational direction of the engagement gear 80. The second contact surface 72*c* may extend along the diameter direction of the second support shaft portion 72, and in a direction perpendicular to the rotational direction of the engagement gear 80. The engagement gear 80 may be rotatable in a predetermined direction, e.g., a counterclockwise direction as shown in FIGS. 4A and 4B.

A base portion of the engaging portion 72*a* may comprise a surface 72*d*. Surface 72 may extend in a direction orthogonal to the rotational direction of the engagement gear 80, continuing from first contact surface 72*b*. The second support shaft portion 72 may comprise a support portion, e.g., a support surface 72*e*, extending along the surface 72*d* and facing the surface 72*d*. A slight gap may be formed between the surface 72*d* of the engaging portion 72*a* and the support surface 72*e* of the second support shaft portion 72. With this structure, if the engagement gear 80 rotates in the clockwise direction as shown in FIG. 4A, the second contact surface 72*c* may be urged by a wall of the engaging groove 81*a* of the engagement gear 80, and the engaging portion 72*a* may be deformed in the rotational direction of the engagement gear 80, such that the surface 72*d* of the engaging portion 72*a* is surely supported by the support surface 72*e*. In this manner, the clockwise rotation of the engagement gear 80 may be restricted.

The outer cylindrical portion 82 of the engagement gear 80 may comprise a toothed portion 82*a* and a toothless portion 82*b*. The toothed portion 82*a* partially may be formed on a peripheral surface of the outer cylindrical portion 82. When the toothed portion 82*a* of the engagement gear 80 engages the transmission gear 67, transmission gear 67 may transmit a driving, rotational force to the toothed portion 82*a*. The toothless portion 82*b* may occupy the peripheral surface that the toothed portion 82*a* does not occupy. The toothless portion 82*b* may avoid engaging the transmission gear 67. The engagement gear 80 may comprise a slit 82*c* in the peripheral surface of the outer cylindrical portion 82*a*, and at a border between the toothed portion 82*a* and the toothless portion 82*b*. The slit 82*c* may extend along an axial direction of the engagement gear 80.

The connection wall 83 may extend in a direction perpendicular to the rotational axis of the engagement gear 80. Referring to FIG. 4C, the engagement gear 80 may comprise a first regulating rib 84 and a first engaging portion, e.g., a second regulating rib 85, provided at predetermined positions on an inner surface 83*a* thereof. The first and second regulating ribs 84 and 85 may have a height which is the same as that of the inner cylindrical portion 81 and the outer cylindrical portion 82. This structure may define a regulating groove 86 as a portion surrounded by the first regulating rib 84, the second regulating rib 85, the inner cylindrical portion 81, the outer cylindrical portion 82, and the connection wall 83. A surface 84*a* of the first regulating rib 84 and a surface 85*a* of the second regulating rib 85, which may comprise the walls of the regulating groove 86, may be positioned on the same circumference of a circle and distanced away from each other in the rotational direction of the engagement gear 80.

Referring to FIG. 4A, a part of a cutout portion 83*b* may be positioned in the connection wall 83 and may continue to the slit 82*c* of the outer cylindrical portion 82. The cutout portion 83*b* may extend from the border between the toothed portion 82*a* and the toothless portion 82*b* to a predetermined position on the side of the toothed portion 82*a*. With this structure, the toothed portion 82*a* may be partially deformable in the diameter direction of the outer cylindrical portion 82. The rotational body 90 may comprise a plate portion, e.g., a rotational frame 91 having a substantially L-shape, an extension portion 92, and an arc-shaped rib 93. The extension portion 92 may protrude toward the cover member 70 from the rotational frame 91. The rib 93 may protrude from an edge of the rotational frame 91 toward a direction opposite to the direction that the extension portion 92 protrudes.

The rotational frame 91 may comprise an arm-like portion which may have a length greater than a radius of the engagement gear 80. The rotational frame 91 may comprise a circular opening 91*a* at a first end. The second support shaft portion 72 may be fitted into the opening 91*a* of the rotational frame 91. Thus, the rotational frame 91 may be rotatable about the second support shaft portion 72. A second end of the rotational frame 91 may have an arc shape. The rotational frame 91 may comprise a second engaging portion, e.g., a projection 91*b* at a predetermined position between the one end and the other end thereof. The projection 91*b* may protrude toward the engagement gear 80. The rotational frame 91 may comprise a surface 94 on which the projection 91*b* may be positioned and a surface 95 which may be an opposite side of the surface 94 of the rotational frame 91.

The projection 91*b* may be positioned within the regulating groove 86 of the engagement gear 80 when the rotational body 90 and the engagement gear 80 are assembled with each other. With this structure, the projection 91*b* of the rotational body 90 may selectively contact the first regulating rib 84 or the second regulating rib 85 of the engagement gear 80 in the rotational direction of the engagement gear 80. Specifically, the engagement gear 80 and the rotational body 90 selectively may be in a first position in which the second regulating rib 85 and the projection 91*b* are separated, or in a second position in which the second regulating rib 85 and the projection 91*b* are engaged. As such, a predetermined gap may be formed between the second regulating rib 85 and the projection 91*b*, such that the rotational body 90 may avoid rotating unless the engagement gear 80 rotates by a predetermined amount in the counterclockwise direction in FIG. 4A.

The extension portion 92 may be positioned at a position shifted from the center of rotation of the rotational frame 91. For example, the extension portion 92 may be formed on the other end of the rotational frame 91 and may protrude toward the outside from the cover member 70 when the rotational body 90 and the cover member 70 are assembled with each other. The extension portion 92 may be positioned on the surface 95 of the rotational frame 91. The rib 93 may be entirely formed at the edge of the arc-shaped other end of the rotational frame 91. Rib 93 may be configured to increase a strength of the rotational body 90.

Figure 5:
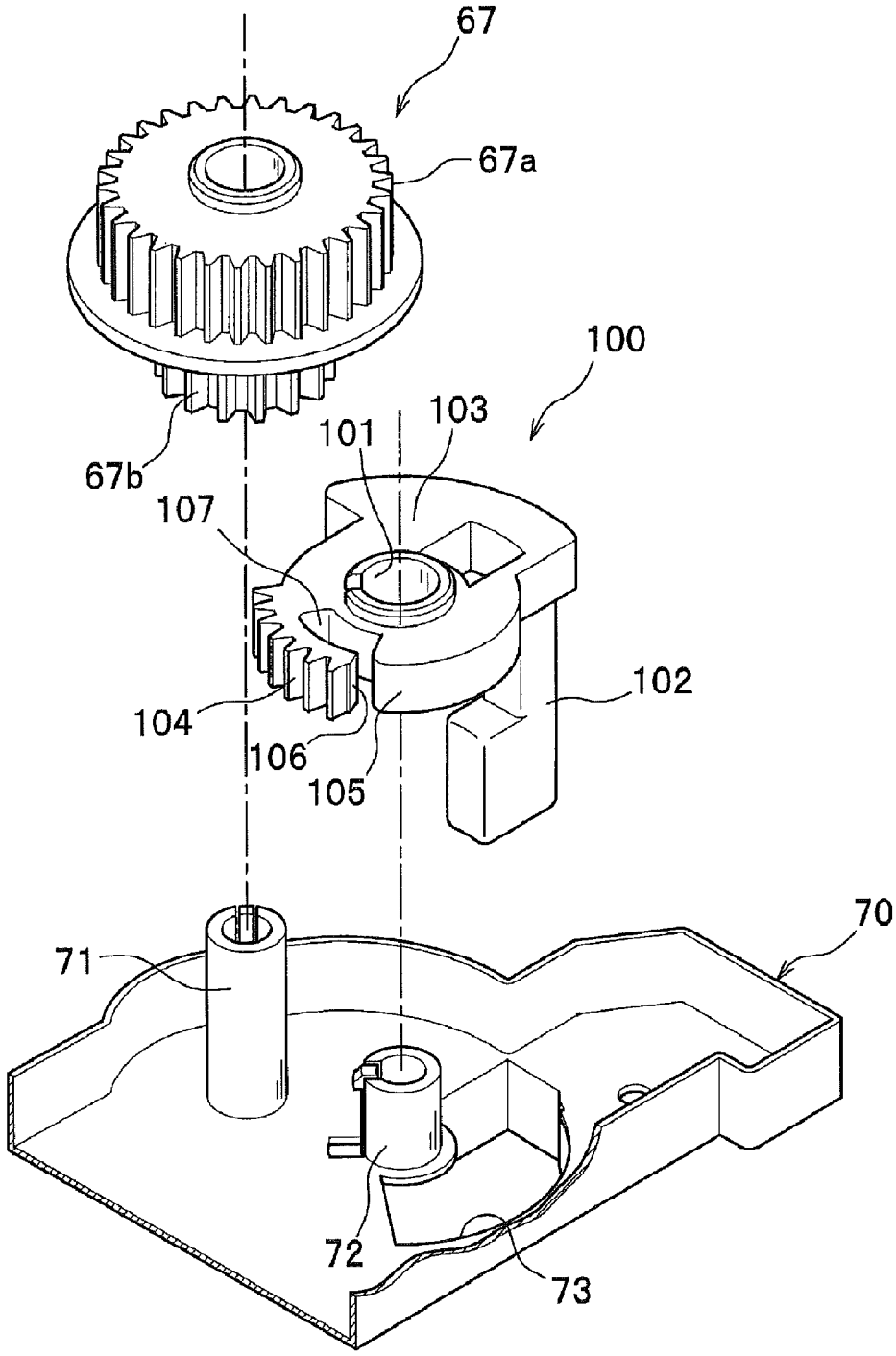
FIG. 5 is an enlarged, perspective view of a cover member, a rotational gear body, and a transmission gear, in which the developer cartridge is configured to be installed in the laser printer of FIG. 1, and in which the developer cartridge is configured to contain developer for forming images on 6000 sheets, according to an embodiment of the invention.

The transmission system, which may be configured to transmit the rotational force from the transmission gear 67 to the extension portion 92, may be designed in accordance with the types of the developer cartridge 28. As described above, referring again to FIG. 4A, the transmission system of a first developer cartridge 28, e.g., a type of developer cartridge configured to form images on a maximum of 3000 sheets, may comprise two components, e.g., the engagement gear 80 and the rotational body 90. Referring to FIG. 5, a transmission system of a second developer cartridge 28, e.g., a developer cartridge configured to form images on a maximum of 6000 sheets, may comprise a single component of a gear rotational body 100. Hereinafter, when the descriptions are common to the first and second developer cartridges 28, reference will be made merely to developer cartridge 28.

The gear rotational body 100, which may be used in the second developer cartridge 28, may comprise a cylindrical shaft portion 101, an extension portion 102, and a connection frame 103. The shaft portion 101 may be rotatably supported by the second support shaft portion 72 of the cover member 70, when the gear rotational body 100 and the cover member 70 are assembled with each other. The extension portion 102 may be formed at a position shifted from a center of rotation of the gear rotational body 100. The connection frame 103 may connect the shaft portion 101 to the extension portion 102. The connection frame 103 may comprise a toothed portion 104 at its base end side. The toothed portion 104 may be partially formed on a peripheral surface of the connection frame 103, and may engage the transmission gear 67. A toothless portion 105 may occupy the peripheral surface where the toothed portion 104 does not occupy. The toothless portion 105 of the gear rotational body 100 may not engage the transmission gear 67. The connection frame 103 may comprise a slit 106 and a cutout portion 107, at a border between the toothed portion 104 and the toothless portion 105. The slit 106 may extend along an axial direction of the shaft portion 101. This structure may allow toothed portion 104 to partially deform in a diameter direction of the gear rotational body 100. The gear rotational body 100 may comprise an engaging groove, which may be substantially similar to the engaging groove 81*a* positioned in the engagement gear 80.

The cover member 70 may be used in both the first and second developer cartridges 28. For example, referring to FIG. 4A, the cover member 70 may comprise an opening, e.g., an elongated groove 73, which may have an arc shape, and the first and second support shaft portions 71 and 72. The extension portion 92 of the rotational body 90, or the extension portion 102 of the gear rotational body 100, may pass through the elongated groove 73 to protrude to the outside when the rotational body 90 or the gear rotational body 100 are assembled with the cover member 70.

Referring back to FIG. 2, the cover member 70 may comprise a groove surrounding wall 74 and an opening 70*a*. The groove surrounding wall 74 may protrude outward, e.g., leftward when positioned as shown in FIG. 2, from an edge of the elongated groove 73. The input gear 62 may be exposed to the outside through the opening 70*a*. The groove surrounding wall 74 may comprise a protection wall 75 at its front side. The protection wall 75 may surround the extension portion 92 of the rotational body 90, or the extension portion 102 of the gear rotational body 100, from three directions, e.g., the rear, the front, and the bottom.

Figure 7:
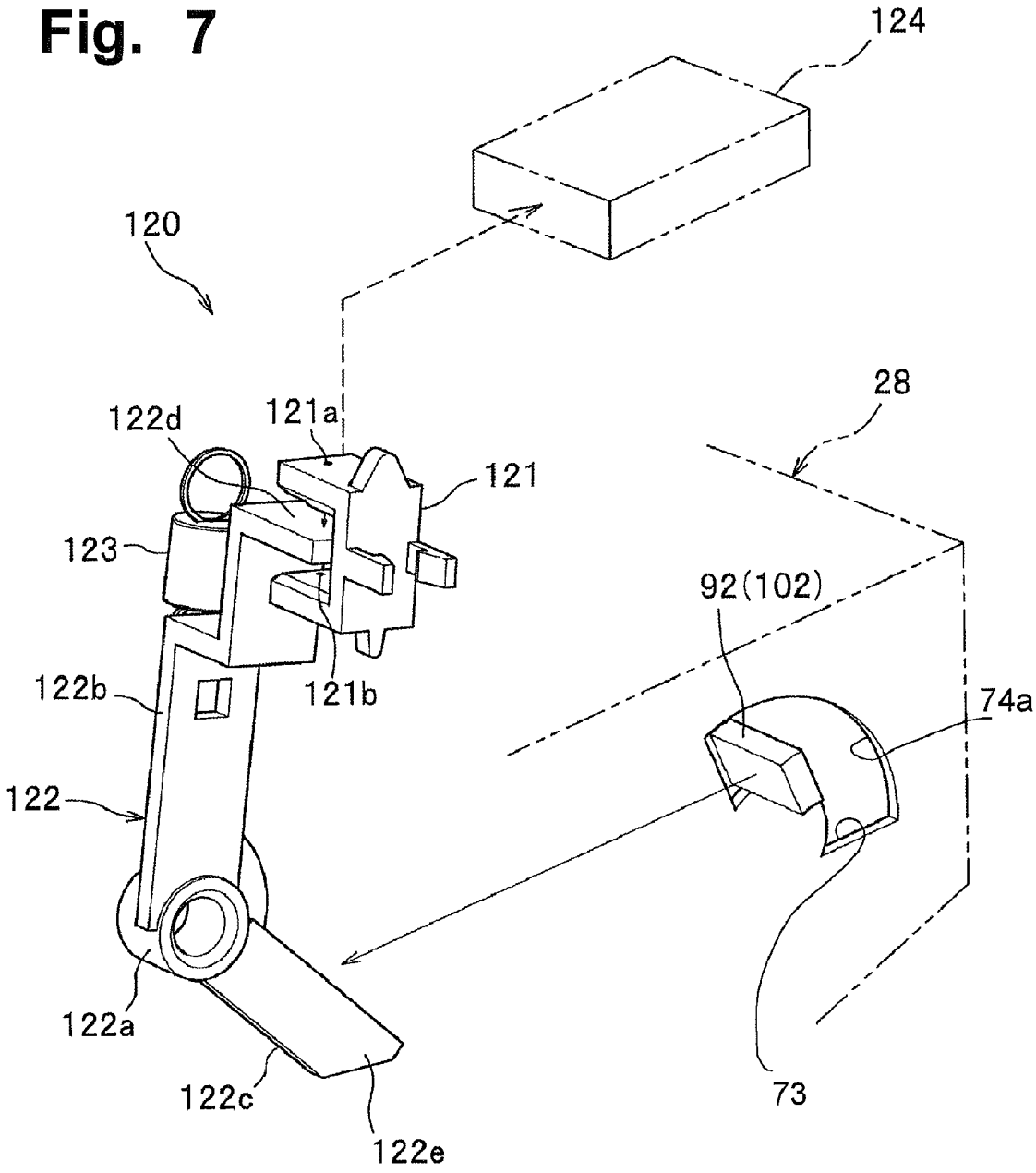
FIG. 7 is a perspective view of components comprising a cartridge condition and a cartridge type detector, according to an embodiment of the invention.

With this structure, the protection wall 75 may protect the extension portion 92, 102 from an application of an external force from the three directions. In addition, a contact wall 74*a* may be positioned at an upper arc portion of the groove surrounding wall 74, and may protrude downward, e.g., toward the extension portion 92 of the rotational body 90, from the grove surrounding wall 74. Referring to FIG. 7, the contact wall 74*a* may be partially provided toward the arc portion of the groove surrounding wall 74, such that a predetermined gap may be formed at both end portions of the arc portion. With this structure, when the engagement gear 80 and the rotational body 90 are in any of the states shown in FIGS. 10B to 10D, the extension portion 92 of the rotational body 90 may contact and may slide over the contact wall 74*a*. A protruding amount of the contact wall 74*a* may be selected, such that a resistance to the extension portion 92 by the contact with the contact wall 74*a* becomes less than the drive force to be transmitted from the transmission gear 67 and becomes greater than the urging force to be applied to the extension portion 92 from the detection arm 122 when the developer cartridge 28 is attached to the body casing 2.

The groove surrounding wall 74 may be shorter in height than the extension portion 92, 102, except the protection wall 75, such that a free end of the groove surrounding wall 74 may be positioned at a level lower than a free end of the extension portion 92, 102. Therefore, the extension portion 92, 102 may contact a portion of the body casing 2 in a front-rear direction at the cartridge installed position when the developer cartridge 28 is installed in the body casing 2 with the extension portion 92, 102 positioned at an initial position, e.g., a rear end position in the elongated groove 73, as shown in FIG. 2. Referring to FIG. 6, the portion of the body casing 2 may comprise components of a device attached to the body casing 2, and may comprise the detection arm 122 of a cartridge condition and type detector 120.

Laser printer 1 may comprise the drive device 110, and the cartridge condition and type detector 120, at a portion in the body casing 2 where the developer cartridge 28 is to be installed. The drive device 110 may be configured to transmit a drive force to the input gear 62 of the developer cartridge 28. The cartridge condition and type detector 120 may be configured to detect whether the installed developer cartridge 28 is a new or a used cartridge, and to detect the type of the installed developer cartridge 28. A new developer cartridge corresponds to a developer cartridge which has not been used for printing before, and the used developer cartridge corresponds to a developer cartridge which previously has been used for printing. Specifically, the developing roller of the new developer cartridge has not been driven before, and the developing roller of the used developer cartridge has been driven before.

The drive device 110 may comprise a plurality of gears (not shown) and a drive motor (not shown). When the developer cartridge 28 is attached to the body casing 2, one of the gears of the drive device 110 may engage the input gear 62, such that the drive force from the drive motor may be transmitted to the input gear 62 via the gears. In the drive device 110, the gear to be engaged with the input gear 62 may be configured to selectively move closer to and further away from the developer cartridge 28, and may be configured to move in synchronization with the opening and closing of the front cover 2*a*. The gear may move toward the developer cartridge 28, and may engage the input gear 62 when the front cover 2*a* is closed. The gear may move away from the developer cartridge 28 and may disengage from the input gear 62 when the front cover 2*a* is opened.

Referring to FIG. 7, the cartridge condition and type detector 120 may comprise a detector, e.g., an optical sensor 121, the detection arm 122, a coil spring 123, and a controller 124. The optical sensor 121 may be configured to detect a swing of the detection arm 122. The optical sensor 121 may comprise a light emitting portion 121*a* and a light receiving portion 121*b*. The light emitting portion 121*a* may be configured to emit light therefrom. The light receiving portion 121*b* may be configured to receive the light emitted from the light emitting portion 121*a*. The optical sensor 121 may be configured to output a predetermined signal to the controller 124 when the light receiving portion 121*b* receives the light from the light emitting portion 121*a*.

The detection arm 122 may comprise a cylindrical portion 122*a*, a light interception arm 122*b*, and a contact arm 122*c*. The cylindrical portion 122*a* may be inserted into a shaft (not shown) positioned at the body casing 2, such that the detection arm 122 may be rotatable about the shaft. The light interception arm 122*b* and the contact arm 122*c* may protrude from the cylindrical portion 122*a* in respective directions, with respect to a diameter direction of the cylindrical portion 122*a*. The detection arm 122 may be configured to swing about the cylindrical portion 122*b*. A coil spring 123 may be attached to an appropriate portion of the light interception arm 122*b* of the detection arm 122. Thus, the detection arm 122 may be urged by the coil spring 123 to be in a predetermined position. When the detection arm 122 is located at the predetermined position, an end portion 122*d* of the light interception arm 122*b* may be positioned between the light emitting portion 121*a* and the light receiving portion 121*b* to intercept the light traveling therebetween, and an end portion 122*e* of the contact arm 122*c* may be located at a position where the end portion 122*e* may contact the extension portion 92, 102 of the developer cartridge 28 attached to the body casing 2.

The controller 124 may be configured to determine whether an installed developer cartridge 28 is a new developer cartridge based on whether the detection arm 122 has swung, e.g., whether the extension portion 92 of the rotational body 90 has moved, and may determine the type of the installed developer cartridge 28 based on an amount of time between when the driving of the drive device 110 begins and when the optical sensor 121 transitions to an off state. For example, the controller 124 may perform an idle rotation, e.g., the agitator 34*a* rotates to agitate the toner stored in the developer cartridge 28, based on a cover close detection signal outputted from a sensor configured to detect the closing of the front cover 2*a*, or a signal outputted when power of the laser printer 1 is turned on. Then, the controller 124 may detect the cartridge condition, e.g., whether the cartridge is new or used, and the cartridge type, e.g., whether the cartridge is the first developer cartridge or the second developer cartridge, based on a signal outputted from the optical sensor 121.

FIGS. 8A-9B and FIGS. 12A-12D illustrate a new developer cartridge 28 according to an embodiment of the invention. Specifically, the actions of the engagement gear 80, the rotational body 90, and the detection arm 122 now will be described with respect to two different types of developer cartridges 28 which may be installed in the body casing 2.

Figure 8A:
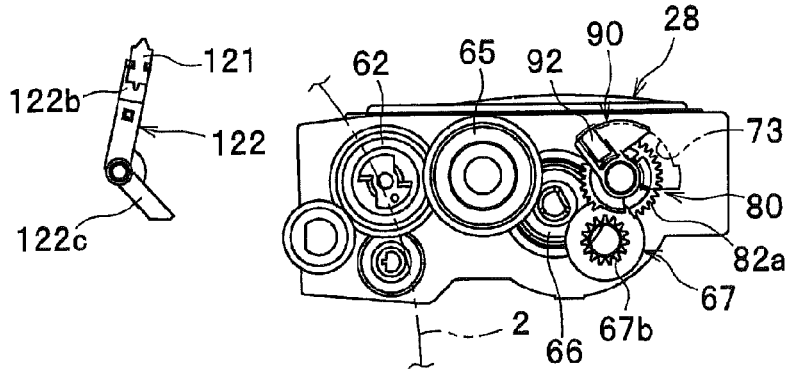
FIG. 8A is a diagram illustrating states of an extension portion, the engagement gear, the rotational body, and the transmission gear of the developer cartridge of FIG. 2, and a contact arm of the cartridge condition and cartridge type detector before the developer cartridge of FIG. 2 is installed in the laser printer of FIG. 1.

Referring to FIG. 8A, when the developer cartridge 28 is not attached to the body casing 2, the extension portion 92 of the first developer cartridge 28 may be located at the rear end position in the elongated groove 73, and the toothed portion 82*a* of the engagement gear 80 may be located at a position which is separated from the transmission gear 67. In this state, referring to FIG. 10A, the projection 91*b* of the rotational body 90 may be located at a position adjacent to the first regulating rib 84 of the engagement gear 80, and the surface 84*a* of the first regulating rib 84 may face a surface of the projection 91*b* of the rotational body 90.

Figure 8B:
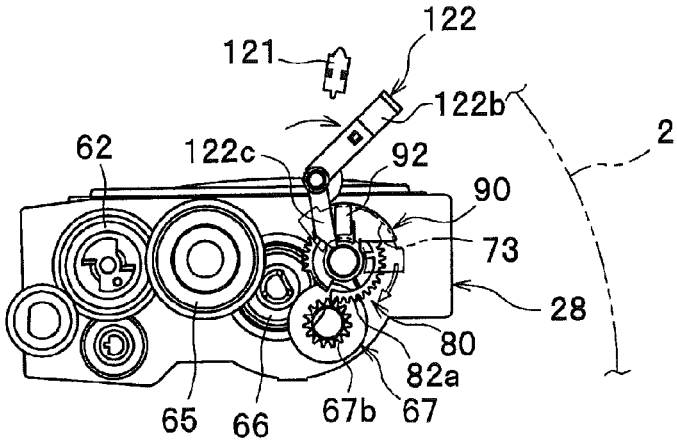
FIG. 8B is a diagram illustrating actions of the extension portion, the engagement gear, the rotational body, the transmission gear, and the contact arm when the developer cartridge of FIG. 2 is installed in the laser printer of FIG. 1, immediately after the developer cartridge of FIG. 2 is attached to the body casing of the laser printer.

Then, when the developer cartridge 28 is being inserted into the body casing 2, the extension portion 92 may contact the contact arm 122*c*, and may apply a force to the contact arm 122*c* of the detection arm 122, which may be urged by the coil spring 123 to the predetermined position. Referring to FIG. 8B, when the developer cartridge 28 is placed at the cartridge installed position in the body casing 2, the contact arm 122*c* of the detection arm 122 may be urged toward the rear by the extension portion 92, against the urging force from the coil spring 123. By this operation, the detection arm 122 may swing, such that the light interception arm 122*b* of the detection arm 122 may move toward the front.

Because the light interception arm 122*b* may move away from the predetermined position, the light emitted from the light emitting portion 121*a* may be received by the light receiving portion 121*b*, and the optical sensor 121 may transition to an on state, and may output a predetermined on signal to the controller 124. At that time, a reverse force may be applied to the extension portion 92 from the detection arm 122, which may be urged by the coil spring 123, such that the extension portion 92 may move toward the front. The extension portion 92 may be pressed by the contact arm 122*c*, and may contact the contact wall 74*a*, and a frictional force may be applied to the extension portion 92, from the contact wall 74*a*, while the extension portion 92 may move toward the front from the rear end position.

Figure 10A:
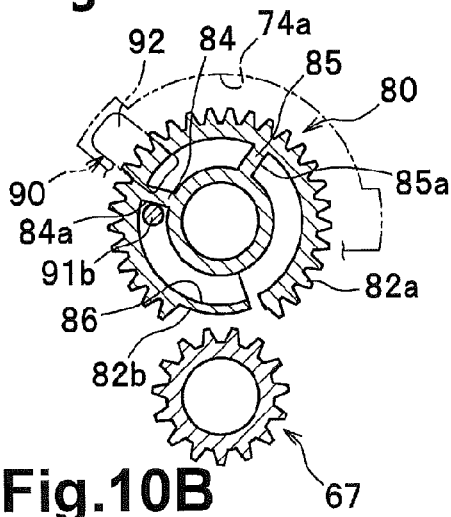
FIG. 10A is a left side, sectional views of the extension portion, the engagement gear, the rotational body, and the transmission gear corresponding to their states and actions shown in FIG. 8A.
Figure 10D:
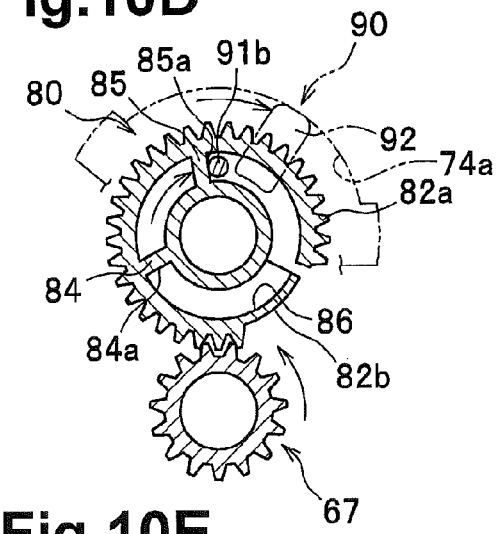
FIG. 10D is a left side, sectional views of the extension portion, the engagement gear, the rotational body, and the transmission gear corresponding to their states and actions shown in FIG. 9A.
Figure 10B:
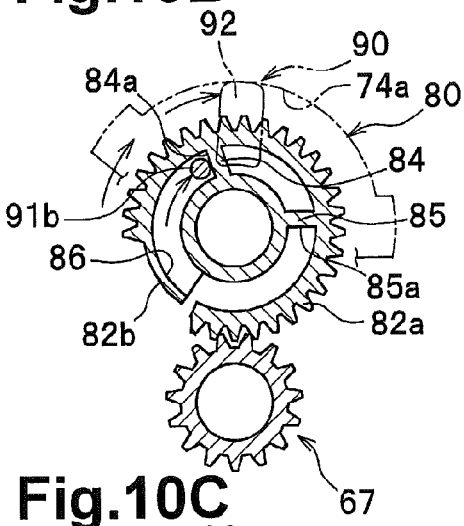
FIG. 10B is a left side, sectional views of the extension portion, the engagement gear, the rotational body, and the transmission gear corresponding to their states and actions shown in FIG. 8B.

Referring to FIGS. 10A and 10B, when the extension portion 92 moves toward the front, the first regulating rib 84 may be pushed toward the front by the projection 91*b*, and the engagement gear 80 may rotate in the clockwise direction by a predetermined amount, together with the rotational body 90. This rotation may cause the projection 91*b* of the rotational body 90 to contact the surface 84*a* of the first regulating rib 84. As the engagement gear 80 rotates, the toothed portion 82*a* of the engagement gear 80 may contact and engage the transmission gear 67.

Figure 11A:
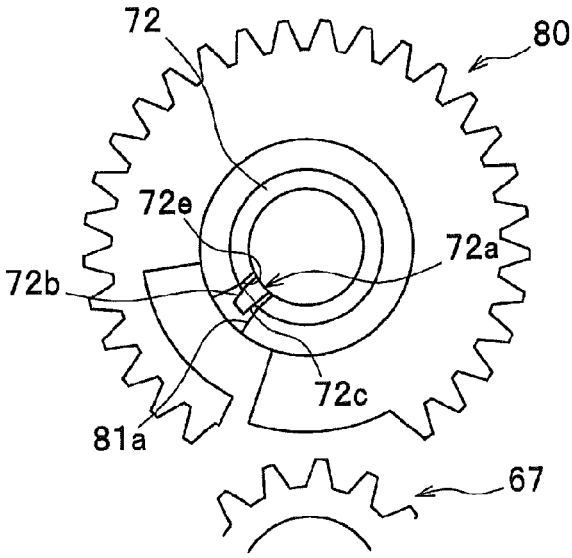
FIG. 11A is a right side, plan views of the gear mechanism when viewed from the inside of the developer cartridge of FIG. 2, showing a relationship between the engaging portion and an engaging groove in the engagement gear, in a state in which the engaging piece and the engaging groove are engaged prior to rotation of the engagement gear.
Figure 11B:
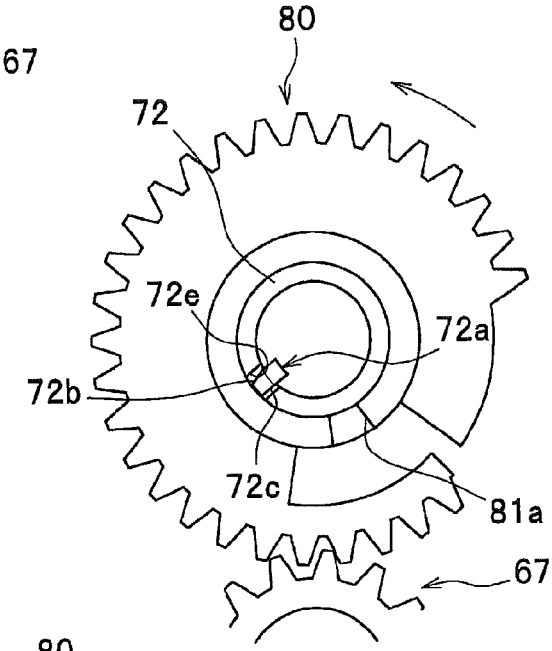
FIG. 11B is a right side, plan views of the gear mechanism when viewed from the inside of the developer cartridge of FIG. 2, showing a relationship between the engaging portion and an engaging groove in the engagement gear, in a state in which the engaging piece is disengaged from the engaging groove, and the engagement gear is rotating.

At that time, referring now to FIGS. 11A and 11B, the engagement gear 80 may rotate while pushing the engaging portion 72*a* inwardly, which may cause a side wall of the engaging groove 81*a* to apply a force to the first contact surface 72*b* of the engaging portion 72*a* of the second support shaft portion 72. As the optical sensor 121 outputs the on signal by detecting the swing of the detection arm 122, the controller 124 may perform the idle rotation based on a signal, e.g., the cover close detection signal, which may indicate the closing of the front cover 2*a*. After the idle rotation starts, the controller 124 may continue to receive the on signal from the optical sensor 121.

Figure 8C:
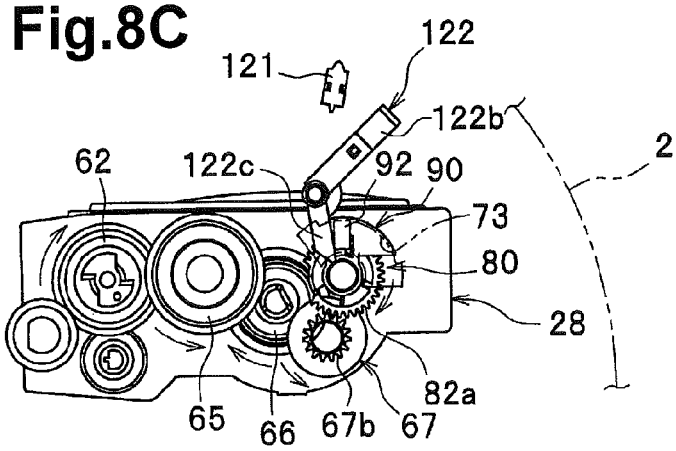
FIG. 8C is a diagram illustrating actions of the extension portion, the engagement gear, the rotational body, the transmission gear, and the contact arm when the developer cartridge of FIG. 2 is installed in the laser printer of FIG. 1, in a state in which the engagement gear is rotating relative to the rotational body.
Figure 10E:
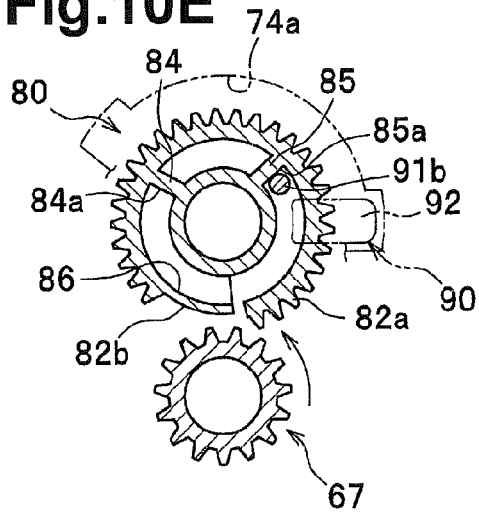
FIG. 10E is a left side, sectional views of the extension portion, the engagement gear, the rotational body, and the transmission gear corresponding to their states and actions shown in FIG. 9B.
Figure 10C:
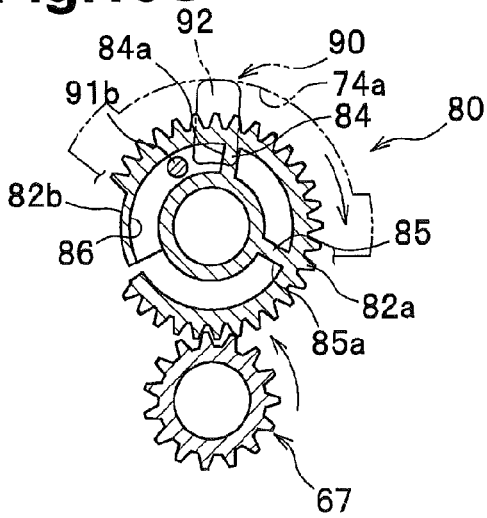
FIG. 10C is a left side, sectional views of the extension portion, the engagement gear, the rotational body, and the transmission gear corresponding to their states and actions shown in FIG. 8C.

Referring to FIG. 8C, as the controller 124 begins the idle rotation, drive device 110 may transmit a drive force to the toothed portion 82*a* of the engagement gear 80 via the input gear 62, the intermediate gear 65, the agitator drive gear 66, and the transmission gear 67. This drive force may cause engagement gear 80 to rotate in the clockwise direction. Referring now to FIG. 10C, at that time, the first regulating rib 84 may be positioned in front of the projection 91*b*, and the extension portion 92 may engage the contact wall 74*a* with the predetermined frictional force, such that the first regulating rib 84 may move toward the front and may be separated from the projection 91*b* retained at the predetermined position. Thus, the engagement gear 80 may rotate in the clockwise direction.

Referring to FIG. 8C, because it may be determined that the frictional force between the extension portion 92 and the contact wall 74*a* becomes greater than the urging force from the contact arm 122*c*, the extension portion 92 may not move when the engagement gear 80 moves alone. Thus, the present position of the detection arm 122 may be maintained, and the optical sensor 121 may continue to output the on signal to the controller 124. Referring to FIG. 10C, thereafter, the second regulating rib 85 gradually may move toward the projection 91*b* as the engagement gear 80 further rotates relative to the rotational body 90.

Referring to FIG. 10D, when the second regulating rib 85 and the projections 91*b* are engaged, the projection 91*b* may be pushed by the second regulating rib 85, and the rotational body 90 may rotate together with the engagement gear 80. As the rotational body 90 rotates, the extension portion 92 further may move toward the front, and may disengage from the contact arm 122*c*, such that the urging force from the coil spring 123 may return detection arm 122 to the predetermined position. Thus, the light interception arm 122*b* of the detection arm 122 also may return to its original position, to intercept the light traveling between the light emitting portion 121*a* and the light receiving portion 121*b*, such that the optical sensor 121 may transition to the off state and may stop the output of the on signal to the controller 124.

Figure 9A:
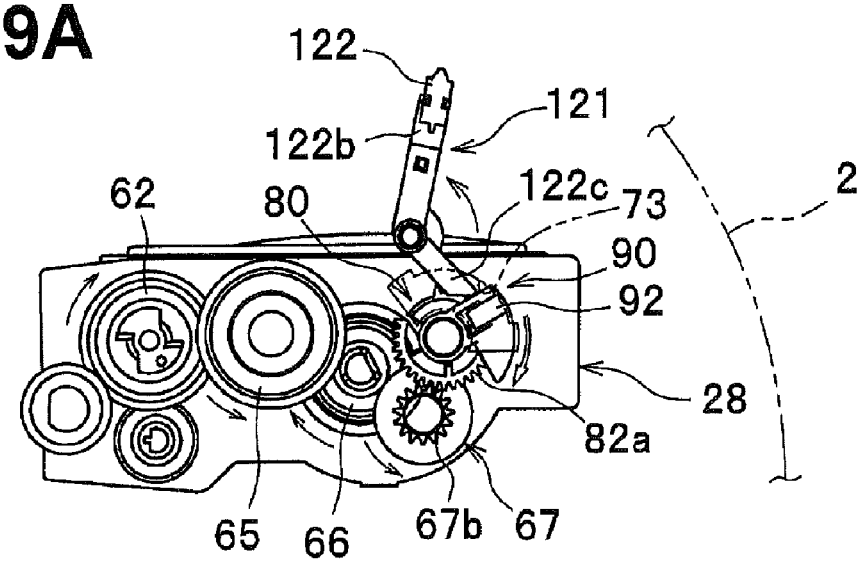
FIG. 9A is a diagram illustrating actions of the extension portion, the engagement gear, the rotational body, the transmission gear, and the contact arm when the developer cartridge of FIG. 2 is installed in the laser printer of FIG. 1, in a state in which the rotational body and the engagement gear are rotating integrally.
Figure 9B:
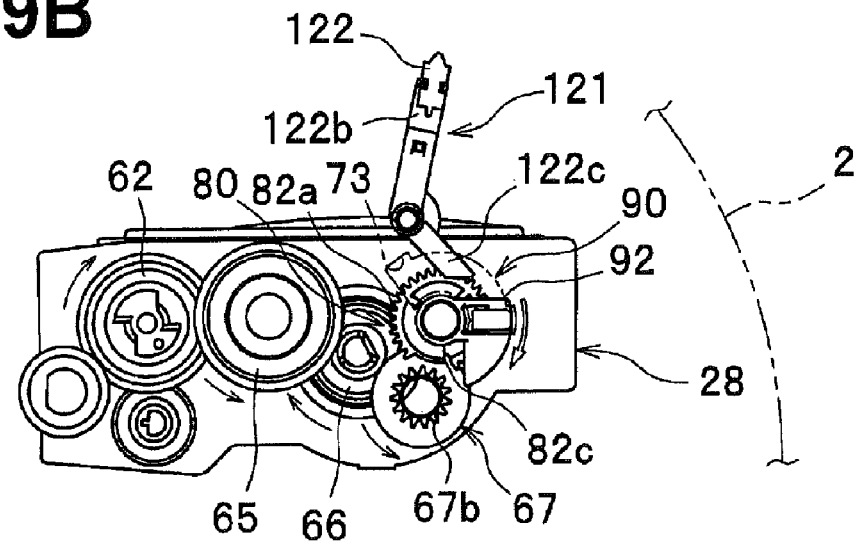
FIG. 9B is a diagram illustrating actions of the extension portion, the engagement gear, the rotational body, the transmission gear, and the contact arm when the developer cartridge of FIG. 2 is installed in the laser printer of FIG. 1, in a state in which the rotational body is rotating nonreversibly.
Figure 11C:
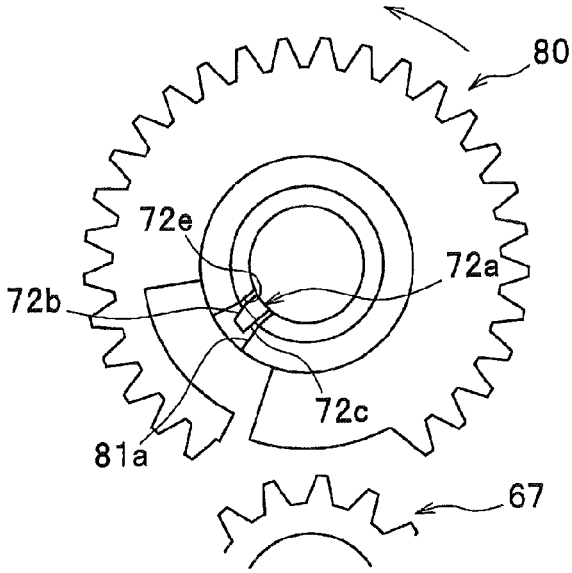
FIG. 11C is a right side, plan views of the gear mechanism when viewed from the inside of the developer cartridge of FIG. 2, showing a relationship between the engaging portion and an engaging groove in the engagement gear, in a state in which the engaging piece and the engaging groove are engaged after rotation of the engagement gear.

Subsequently, referring to FIGS. 9B and 10E, when the rotational body 90 further rotates in the clockwise direction and the extension portion 92 reaches a front end position in the elongated groove 73, the toothed portion 82*a* of the engagement gear 80 may disengage from the transmission gear 67, and the rotation of the rotational body 90 is stopped, that is, the rotational body 90 rotates nonreversibly. At that time, referring to FIG. 11C, the engaging groove 81*a* of the engagement gear 80 may return to its original position, and again may engage the engaging portion 72*a*. Thus, even when a force acting in the clockwise direction in FIG. 11 is applied to the engagement gear 80, the engaging groove 81*a* and the second contact surface 72*c* may be engaged, and the rotation of the engagement gear 80 may be stopped, which may cause the engaging portion 72*a* to deform in the rotational direction of the engagement gear 80. Thus, the engagement gear 80 may not be allowed to again engage the transmission gear 67. Subsequently, the controller 124 may complete the idle rotation and may perform the cartridge condition and the cartridge type detection, based on the presence or the absence of the on signal provided from the optical sensor 121 and a duration of time the controller 124 receives the on signal.

The actions of the engagement gear 80, the gear rotational body 100, and the detection arm 122 when the second developer cartridge 28 is to be installed in the body casing 2 will be described herein. The actions of the engagement gear 80, the gear rotational body 100, and the detection arm 122 similar to the actions of those when the first developer cartridge 28 is attached to the body casing 2 are omitted.

Figures 12A, 12B, 12C, 12D:
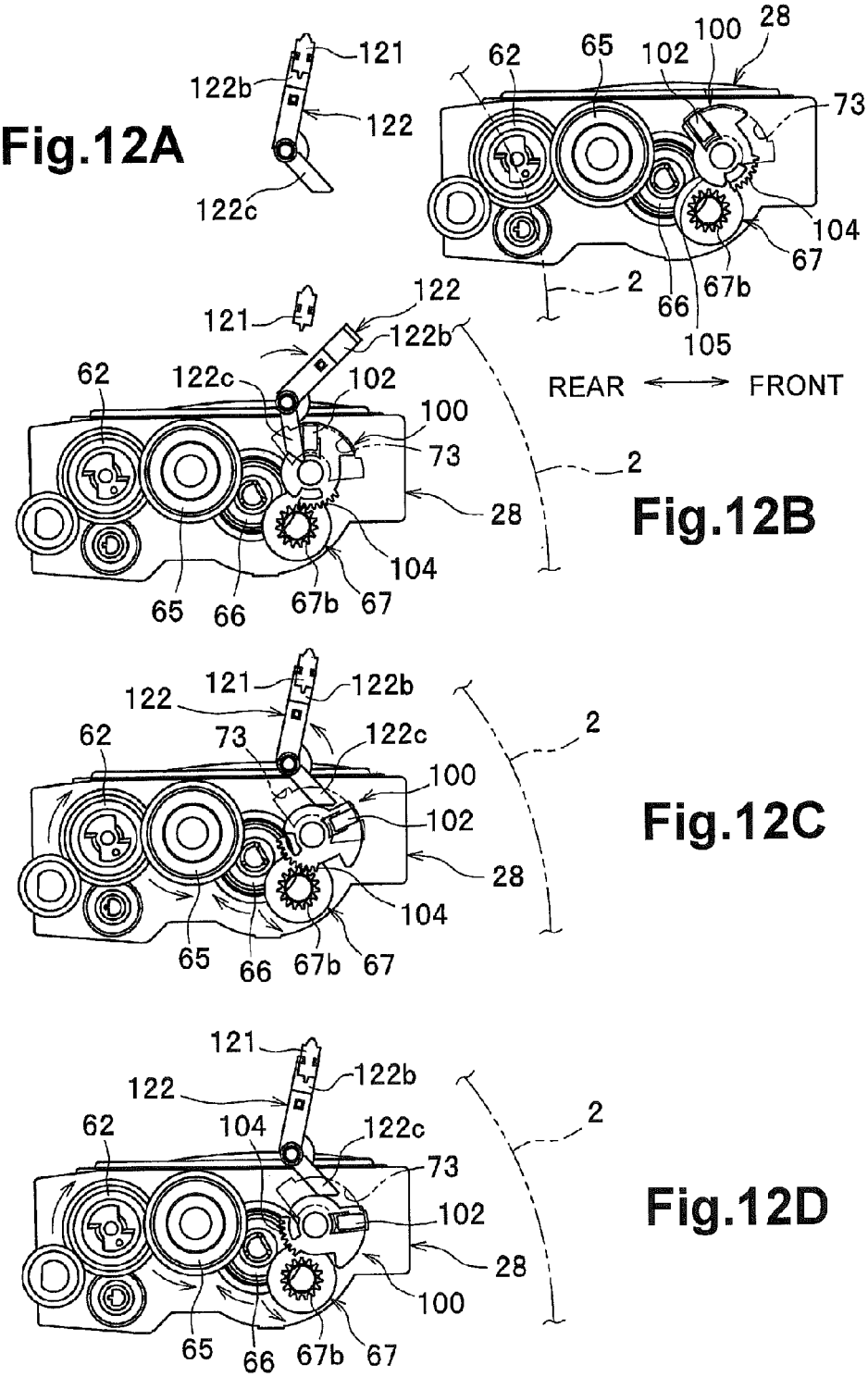
FIG. 12A is a diagram illustrating states of the extension portion, the engagement gear, the gear rotational body, and the transmission gear of a developer cartridge, which may be configured contain developer for forming images on 6000 sheets, and the contact arm of the cartridge condition and the cartridge type detector before the developer cartridge is installed in the laser printer of FIG. 1, according to another embodiment of the present invention.
FIG. 12B is a diagram illustrating actions of the extension portion, the engagement gear, the rotational body, the transmission gear, and the contact arm, in a state immediately after the developer cartridge of FIG. 12A is installed in the laser printer of FIG. 1.
FIG. 12C is a diagram illustrating actions of the extension portion, the engagement gear, the rotational body, the transmission gear, and the contact arm, after the cartridge of FIG. 12A is installed in the laser printer of FIG. 1, in a state in which an idle rotation is being performed.
FIG. 12D is a diagram illustrating actions of the extension portion, the engagement gear, the rotational body, the transmission gear, and the contact arm, after the cartridge of FIG. 12A is installed in the laser printer of FIG. 1, in a state in which the rotational body is rotating nonreversibly.

Referring to FIGS. 12A and 12B, when the second developer cartridge 28 is attached to the predetermined installed position in the body casing 2, the detection arm 122 may swing toward the front, and the optical sensor 121 may output an on signal to the controller 124. Then, the controller 124 may perform the idle rotation. Referring to FIG. 12C, as the controller 124 performs the idle rotation, the gear rotational body 100 immediately may rotate in the clockwise direction, and the extension portion 102 may move toward the front. Therefore, the detection arm 122 may disengage from the extension portion 102 and may return to the predetermined position by the urging force from the coil spring 123. Thus, the optical sensor 121 may stop the output of the on signal. Specifically, the duration of time that the controller 124 receives the on signal may be less than the duration of time that the controller 124 receives the on signal when the first developer cartridge 28 is attached to the body casing 2.

Figures 13A, 13B:
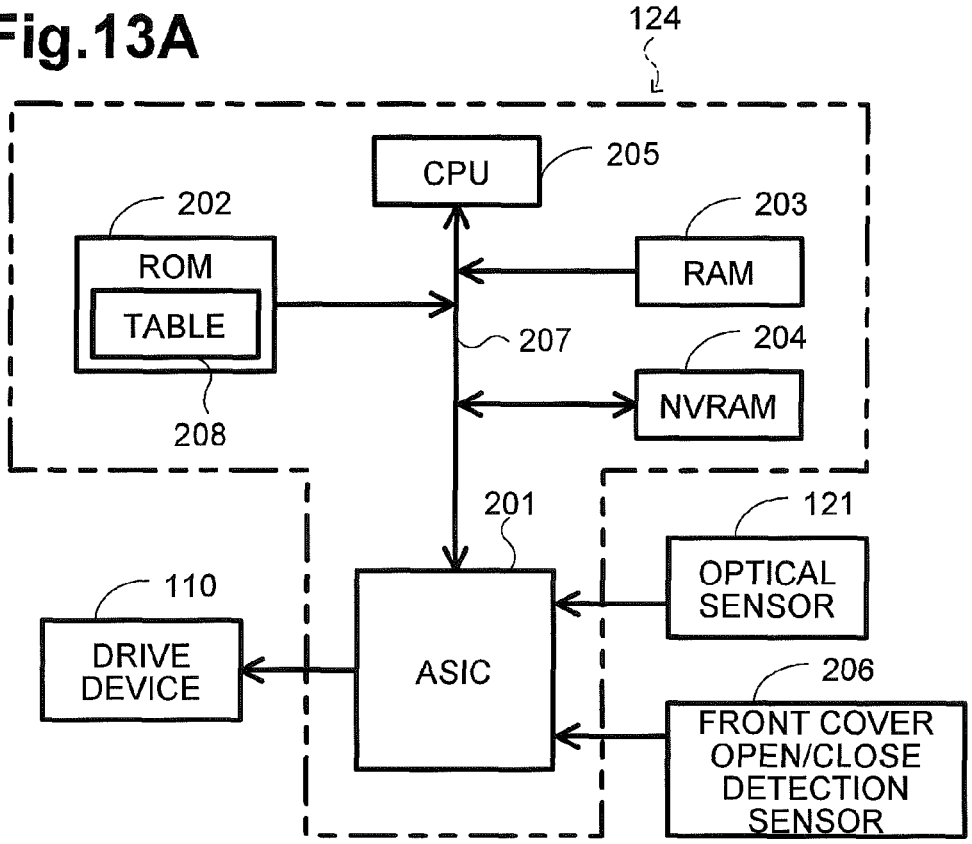
FIG. 13A is a block diagram of a controller of the laser printer of FIG. 1, according to an embodiment of the present invention.
FIG. 13B is a diagram showing a table stored in a ROM of FIG. 13A.

Subsequently, referring to FIG. 12D, the gear rotational body 100 may rotate nonreversibly. Then, the controller 124 completes the idle rotation and performs the cartridge condition and the cartridge type detection based on the presence or the absence of the on from the optical sensor 121 and the duration of time that the controller 124 receives the on signal. Referring to FIG. 13A, the controller 124 may comprise an application-specific integrated circuit (ASIC) 201, a storage, e.g., a read-only memory (ROM) 202, a random-access memory (RAM) 203, a nonvolatile random-access memory (NVRAM) 204, and a central processing unit (CPU) 205.

The ASIC 201 may be configured to control the units of the laser printer 1. The ASIC 201 may be coupled to the drive device 110, the optical sensor 121, and a front cover open/close detection sensor 206. Although not shown, the front cover open/close detection sensor 206 may comprise a switch which is turned on by the contact of the front cover 2*a*. The front cover open/close detection sensor 206 may be turned on and may input a cover close detection signal to the CPU 205 via the ASIC 201 when the opened front cover 2*a* is closed with respect to the body casing 2. The drive device 110 (the motor) may be controlled by the ASIC 201 via the execution of various programs by the CPU 205. The ASIC 201 may be coupled to the ROM 202, the RAM 203, the NVRAM 204, and the CPU 205, via a bus 207.

The ROM 202 may be configured to store various programs to be executed by the CPU 205, such as a program for performing the cartridge condition and the cartridge type detection. The ROM 202 also may be configured to store a table 208 which is referred to during the cartridge condition and the cartridge type detection. The table 208 sets forth correspondences between times required between when the driving of the drive device 110 starts and when the optical sensor 121 transitions to the off state, e.g., an extension portion moving time, and the types of the developer cartridge 28, according to an embodiment of the invention.

Figure 14:
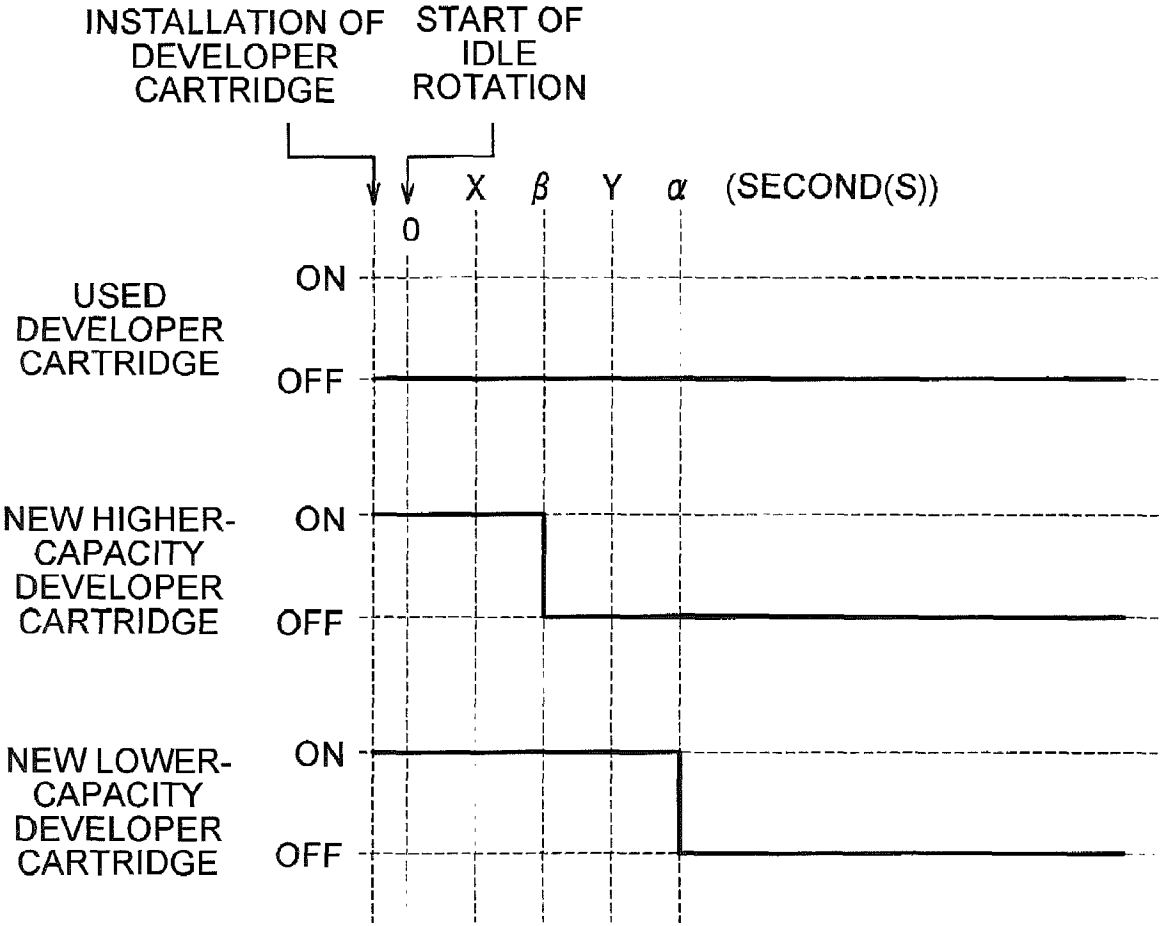
FIG. 14 is a timing chart showing a state of an optical sensor during a cartridge condition and cartridge type detection.

Referring to FIG. 13B, when the extension portion moving time is $\alpha$, the cartridge type may be the first developer cartridge 28, and when the extension portion moving time is $\beta$, the cartridge type may be the second developer cartridge 28. The RAM 203 may be configured to temporarily store numerical values when the various programs are preformed. Referring to FIG. 14, the NVRAM 204 may be configured to store the presence or the absence of the input of a light reception signal in the optical sensor 121, and a measurement time of the input of the light reception signal. The cartridge condition and the cartridge type detection may be performed when the CPU 205 performs the cartridge condition and the cartridge type detection program stored in the ROM 202.

Figure 15A:
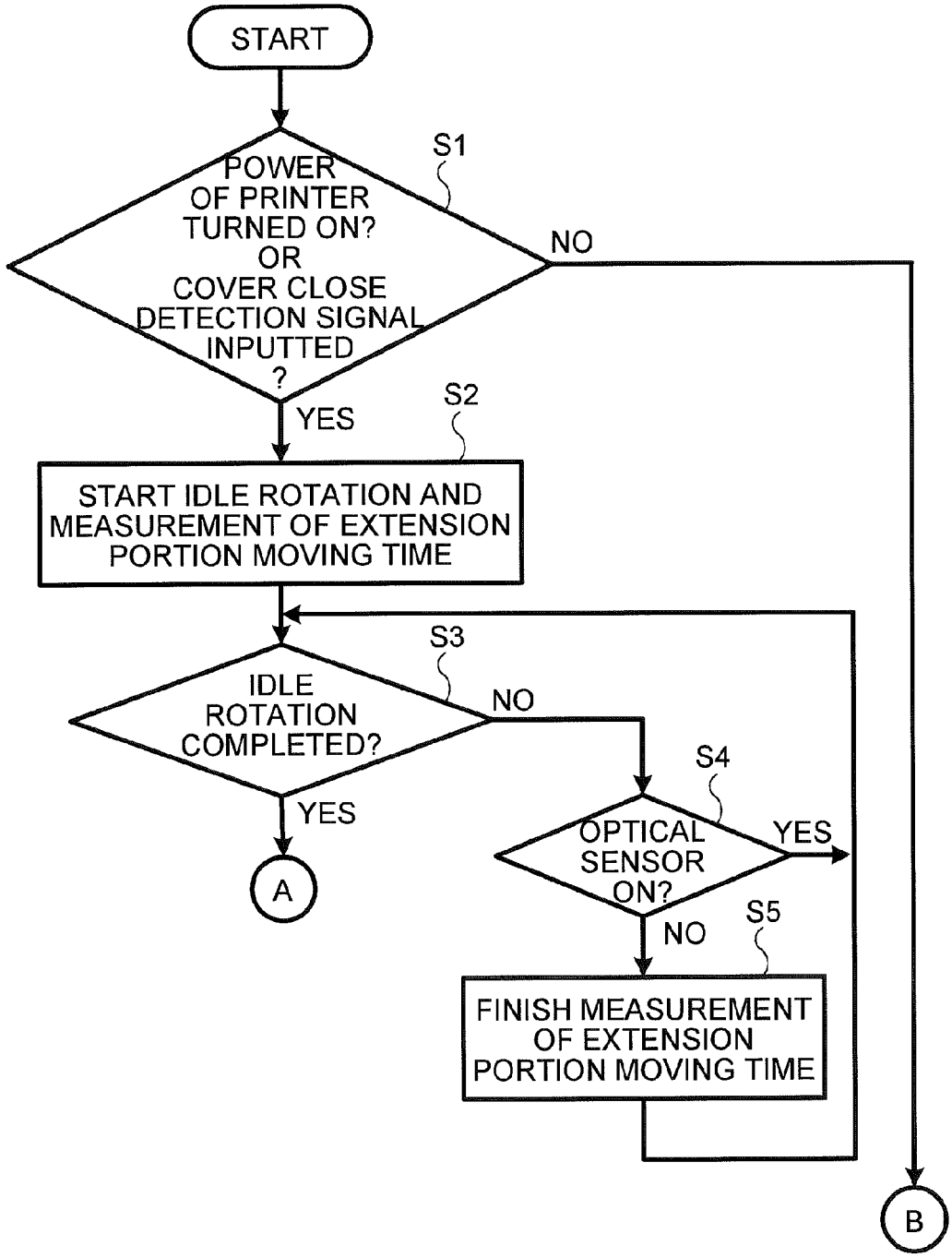
FIG. 15A is a flowchart of the cartridge condition and the cartridge type detection according to another embodiment of the present invention.
Figure 15B:
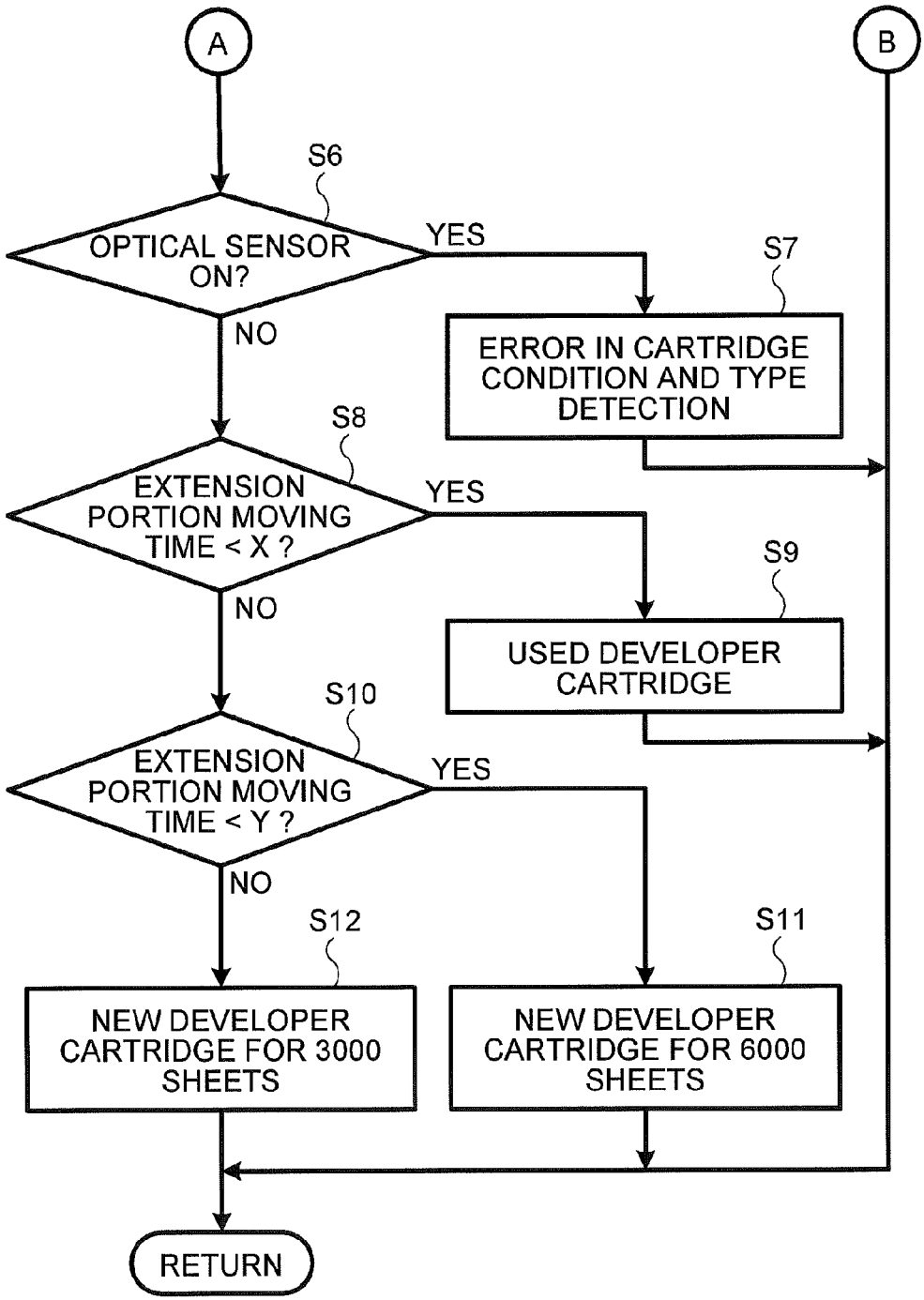
FIG. 15B is a continuation of the flowchart of FIG. 15A.

Referring to FIGS. 14, 15A, and 15B, the cartridge condition and the cartridge type detection now may be described. FIG. 14 refers to timing of the transition between the on state and the off state of the optical sensor 121 in each case when a new second developer cartridge 28, a new first developer cartridge 28, or a used developer cartridge 28 is installed in the body casing 2.

As the new first developer cartridge 28 is attached to the body casing 2, the extension portion 92 may contact the detection arm 122. Thus, the detection arm 122 may swing toward the front, and the optical sensor 121 may transition to the on state. Then, when the CPU 205 controls the drive device 110 to drive to perform the idle rotation, the engagement gear 80 rotates for the predetermined amount of time, such that the extension portion 92 may enter the fixed state, and the optical sensor 121 may be maintained in the on state. When the second regulating rib 85 of the engagement gear 80 and the projection 91*b* of the rotational body 90 engage, the rotational body 90 may rotate, together with the engagement gear 80, and the extension portion 92 may disengage from the detection arm 122. Thus, the detection arm 122 may return to the predetermined position, and the optical sensor 121 may transition to the off state. Specifically, when the new first developer cartridge 28 is attached to the body casing 2, the extension portion moving time is a seconds.

As the new second developer cartridge 28 is attached to the body casing 2, the extension portion 102 may contact the detection arm 122, and the optical sensor 121 may transition to an on state, and the input of the light reception signal into the CPU 205 may begin via the swing of the detection arm 122.

Subsequently, when the CPU 205 controls the drive device 110 to drive to perform the idle rotation, the extension portion 102 may disengage from the detection arm 122, and the detection arm 122 may return to the predetermined position.

Thus, the optical sensor 121 may transition to the off state, and the input of the light reception signal to the CPU 205 may stop. Specifically, when the new second developer cartridge 28 is attached to the body casing 2, the extension portion moving time may be β seconds.

As described above, when the new first developer cartridge 28 is attached to the body casing 2, the extension portion moving time is α seconds. The extension portion moving time of α seconds, may be greater than the extension portion moving time of β seconds, when the new second developer cartridge 28 is attached. When the used developer cartridge 28, such as a used second developer cartridge or a used first developer cartridge, is attached to the body casing 2, the extension portion 92, 102 may be located at the front end portion in the elongated groove 73, such that the extension portion 92, 102 may not engage with the detection arm 122. Thus, the optical sensor 121 may be maintained in the off state.

As shown in FIG. 14, letters "X (seconds)"" and "Y (seconds)," may be threshold values which may be used in the cartridge condition and the cartridge type detection, in which X is a threshold value set between 0 second and β seconds, and Y is a threshold value set between β seconds and α seconds.

Referring to FIGS. 15A and 15B, the cartridge condition and the cartridge type detection to be performed by the CPU 205 now is described. First, it is determined whether the power of the laser printer 1 has been turned on or whether a cover close detection signal has been inputted to the CPU 205 (Step 1, hereinafter S stands for a step). When it is determined that the power of the laser printer 1 has not been turned on or a cover close detection signal has not been inputted to the CPU 205 from the front cover open/close detection sensor 206 (S1:NO), flow returns to a main routine (not shown) and repeats the determination of S1. When it is determined that the power of the laser printer 1 has been turned on or a cover close detection signal has been inputted to the CPU 205 (S1:YES), the idle rotation is performed (S2). At S2, the CPU 205 outputs a predetermined drive signal to the drive device 110, and allows the counter (not shown) to measure the extension portion moving time. The measurement of the extension portion moving time only is performed when the optical sensor 121 is in the on state.

FIGS. 15A and 15B, describe the cartridge condition and the cartridge type detection to be performed by the CPU 205 according to an embodiment of the invention. First, in Step S1 (hereinafter all steps will be referred to by their "Sx" number, in which "x" is the number of the step), a determination may be made whether the power of the laser printer 1 has been turned on, or whether a cover close detection signal has been inputted to the CPU 205 When it is determined that the power of the laser printer 1 has not been turned on or a cover close detection signal has not been inputted to the CPU 205 from the front cover open/close detection sensor 206, e.g., Step S1:NO, flow returns to a main routine (not shown) and repeats the determination of S1. When it is determined that the power of the laser printer 1 has been turned on or a cover close detection signal has been inputted to the CPU 205, e.g., S1:YES, idle rotation may be performed at S2. At S2, the CPU 205 may output a predetermined drive signal to the drive device 110, and may allow the counter (not shown) to measure the extension portion moving time. The measurement of the extension portion moving time only may be performed when optical sensor 121 is in the on state.

After the idle rotation begins, it may be determined whether the idle rotation has been completed at S3. When it is determined that the idle rotation has not yet been completed, e.g., the idle rotation is still being performed, e.g., S3:NO, it is determined whether the optical sensor 121 is in the on state, i.e., a light receiving signal may be inputted, S4. When it is determined that the optical sensor 121 is in the on state, e.g., S4:YES, flow may return to S3 to determine again whether the idle rotation has been completed. When it is determined that the optical sensor 121 is in the off state, e.g., S4:NO, the CPU 205 may allow the counter to stop the measurement of the extension portion moving time, S5. After that, flow may return to S3.

When it is determined that the idle rotation has been completed, e.g., S3:YES, it may be determined whether the optical sensor 121 is in the on state, S6. When it is determined that the optical sensor 121 is in the on state, e.g., S6:YES, the extension portion moving time may not have been correctly measured, because the extension portion 92, 102 and the detection arm 122 still may be in contact with each other even though, the idle rotation may be complete. Therefore, it may be determined that an error has occurred during the cartridge condition and the cartridge type detection, S7, and flow may return to the main routine. When it is determined that an error has occurred during the cartridge condition and the cartridge type detection, a display on an operating panel (not shown) may indicate that an error occurred.

When it is determined that the optical sensor 121 is in the off state, e.g., S6:NO, it may be determined that the extension portion moving time has been correctly measured, and it may be determined whether an obtained value of the extension portion moving time is less than the threshold value X, at S8. When it is determined that the value of the extension portion moving time is less than the threshold value X, e.g., S8:YES, it may be determined that the installed developer cartridge 28 is a used cartridge, at S9, and flow may return to the main routine. When it is determined that the installed developer cartridge 28 is an used cartridge, every time printing is performed on a sheet, the CPU 205 may begin counting the number of sheets that have been printed, starting from the number of sheets that have been printed that were counted up and stored prior to removal of the developer cartridge 28 from the body casing 2.

When it is determined that the value of the extension portion moving time is not less than the threshold value X, e.g., S8:NO, it may be determined whether the value of the extension portion moving time is less than the threshold value Y, S10. When it is determined that the value of the extension portion moving time is less than the threshold value Y, e.g., S10:YES, it may be determined that the extension portion moving time is β seconds. After that, the table 208 stored in the ROM 202 may be referenced, and it may be determined that the installed developer cartridge 28 is a new second developer cartridge 28, S11. Then, flow may return to the main routine. When it is determined that the installed developer cartridge 28 is a new second developer cartridge 28, the CPU 205 may indicate via the operating panel that the toner is empty. Specifically, the CPU 205 may indicate that the toner is empty when a sheet discharge sensor (not shown) detects that images have been formed on 6000 sheets since installation of the second developer cartridge 28.

When it is determined that the value of the extension portion moving time is not less than the threshold value Y, e.g., S10:NO, it may be determined that the value of the extension portion moving time is greater than or equal to the threshold value Y, e.g., the extension portion moving time is α seconds. After that, the table 208 may be referred to, and it may be determined that the installed developer cartridge 28 is a new first developer cartridge 28. Then, flow may return to the main routine. When it is determined that the installed developer cartridge 28 is a new first developer cartridge 28, the CPU 205 may indicate via the operating panel that the toner is empty. Specifically, the CPU 205 may indicate the toner is empty when the sheet discharge sensor detects that images have been formed on 3000 sheets since installation of the first developer cartridge 28.

In an embodiment of the invention, the engagement gear 80 may rotate separately from the rotational body 90 while the engagement gear 80 and the rotational body 90 transition to the second state from the first state, such that the movement of the extension portion 92 may be restricted even when an undesired rotational force is transmitted to the engagement gear 80 via the gear mechanism 61, due to an unintentional operation by the user. The cartridge condition and the cartridge type detection may be accurately performed using the transmission system configured to transmit the rotational force from the transmission gear 67 to the extension portion 92, 102 and comprising a single or two components, and the rotation start time of the rotational body 90 and the gear rotational body 100 may be accurately determined based on the types of the developer cartridges 28 to be used. In addition, although the start timing of the movement of the extension portions 92, 102 may be different from each other, the moving distance of the extension portions 92, 102 may be the same. Therefore, it may not be necessary to increase the rotational amount of the rotational body, e.g., a size of a groove, such that two contact protrusions contact the actuator, which may reduce the size of developer cartridge 28.

In an embodiment of the invention, the moving distance of the extension portion 92, 102 may be increased to accurately detect the movement of the extension portion 92, 102 by the detector. The diameter of the rotational body 90 may be increased to increase the moving distance of the extension portion 92. Rotational body 90 and the engagement gear 80 may be positioned as separate parts, and the rotational body 90 may comprise the arm-like portion which may have a length greater than the radius of the engagement gear 80.

The extension portion 92 is relatively moved toward the front with respect to the first developer cartridge 28 by the contact arm 122*c*, and the toothed portion 82*a* of the engagement gear 80 engages the transmission gear 67 when the first developer cartridge 28 is attached to the body casing 2. With this structure, unless a force is applied to the extension portion 92, the toothed portion 82*a* of the engagement gear 80 and the transmission gear 67 are separated from each other while the developer cartridge 28 is not attached to the body casing 2. Therefore, even if the gears 62-67 of the first developer cartridge 28 are rotated during product testing before shipping, the engagement gear 80 and the rotational body 90 do not rotate with the gears 62-67, such that the extension portion 92 may be maintained at an appropriate position until the developer cartridge 28 is first attached to the body casing 2.

The second support shaft portion 72 of the cover member 70 may comprise the engaging portion 72*a*, which may be configured to maintain the state in which the toothless portion 82*b* of the engagement gear 80, or the toothless portion 105 of the gear rotational body 100, and the transmission gear 67 face each other, until a predetermined amount of force is applied to the engagement gear 80. Thus, the extension portion 92, 102 may be maintained at the appropriate position until the developer cartridge 28 is first attached to the body casing 2.

The engaging portion 72*a* may comprise the first contact surface 72*b*, which may incline with respect to the diameter direction of the second support shaft portion 72, and which may contact the surface of the engaging groove 81*a*, and the second contact surface 72*c*, which extends along the diameter direction of the second support shaft portion 72 and contacts the other surface of the engaging groove 81*a*. Further, second support shaft portion 72 may comprise the support surface 72*e* which supports the engaging portion 72*a* when the engaging portion 72*a* is pressed by the engagement gear 80 via the second contact surface 72*c*. Thus, the engagement gear 80 may be configured to rotate in the one direction, such that engagement gear 80 may nonreversibly rotate.

The transmission gear 67 may comprise the reduction gear, which may be configured to reduce the speed of the rotation of the engagement gear 80. Therefore, the extension portion moving time may be adjusted within the wide range, such that the type of the installed developer cartridge 28 may be reliably detected. In an embodiment of the invention, even if the gears 62 to 66, which may be configured to transmit a rotational force to the transmission gear 67, are undesirably rotated due to an accidental operation by the user, the transmission gear 67 may be configured to reduce the speed of the engagement gear 80, such that the rotation of the engagement gear 80 may be restricted.

The protection wall 75 may be positioned on the front side of the elongated groove 73 to surround the extension portion 92, 102 from the three directions, e.g., from the rear, the front and the bottom. In an embodiment of the invention, the protection wall 75 may protect the extension portion 92, 102 from the application of an external force from the three directions, when the extension portion 92, 102 may be located at the front end position in the elongated groove 73. Thus, for example, when the developer cartridge 28 may be removed from the body casing 2 due to paper jam, the extension portion 92, 102 may be protected by the protection wall 75.

The toothed portion 82*a* and the toothed portion 104 may be inwardly deformable in the diameter direction of the engagement gear 80 and the gear rotational body 100, respectively. With this structure, even if the developer cartridge 28 may be forcibly attached to the body casing 2 and the engagement gear 80, or the gear rotational body 100 rotates and the toothed portion 82*a* or the toothed portion 104 forcibly contacts the transmission gear 67, the impact of the collision may be absorbed. In an embodiment of the invention, even if the tips of the teeth of the toothed portion 82*a*, 104 and the transmission gear 67 contact each other, the tips of the teeth of the toothed portion 82*a*, 104 and the transmission gear 67 may slip off each other, due to the deformation of the toothed portion 82*a*, 104, such that the toothed portion 82*a*, 104 and the transmission gear 67 may remain engaged.

In an embodiment of the invention described above, the extension portion 92 may be supported by the contact wall 74*a* with the predetermined frictional force, such that the detection arm 122 may be maintained at the position. In another embodiment of the invention, the second regulating rib 85 of the engagement gear 80 and the projection 91*b* of the rotational body 90 may be an example of an adjuster. The transmission gear 67 may be used as an example of the adjuster by changing its gear ratio based on the types of the developer cartridges 28 to be used, instead of adopting the gear rotational body 100 in the both types of the developer cartridges 28.

Figure 16:
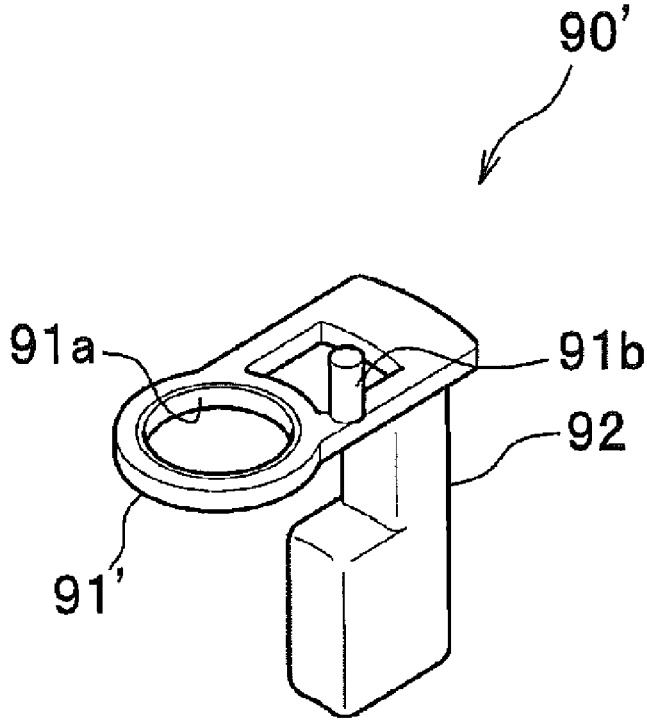
FIG. 16 is a perspective view of a rotational body, according to still another embodiment of the present invention.

In another embodiment of the invention, the rotational body 90 may be shaped in a different manner. Referring to FIG. 16, a rotational body 90' may comprise a rotational frame 91' having a substantially rectangular plate shape, if the rotational body 90' has an opening 91*a*, a projection 91*b*, and an extension portion 92 which may be the same as those of the rotational body 90 described above. The circular rib 93 may be omitted in an embodiment of the invention.

Figure 17A:
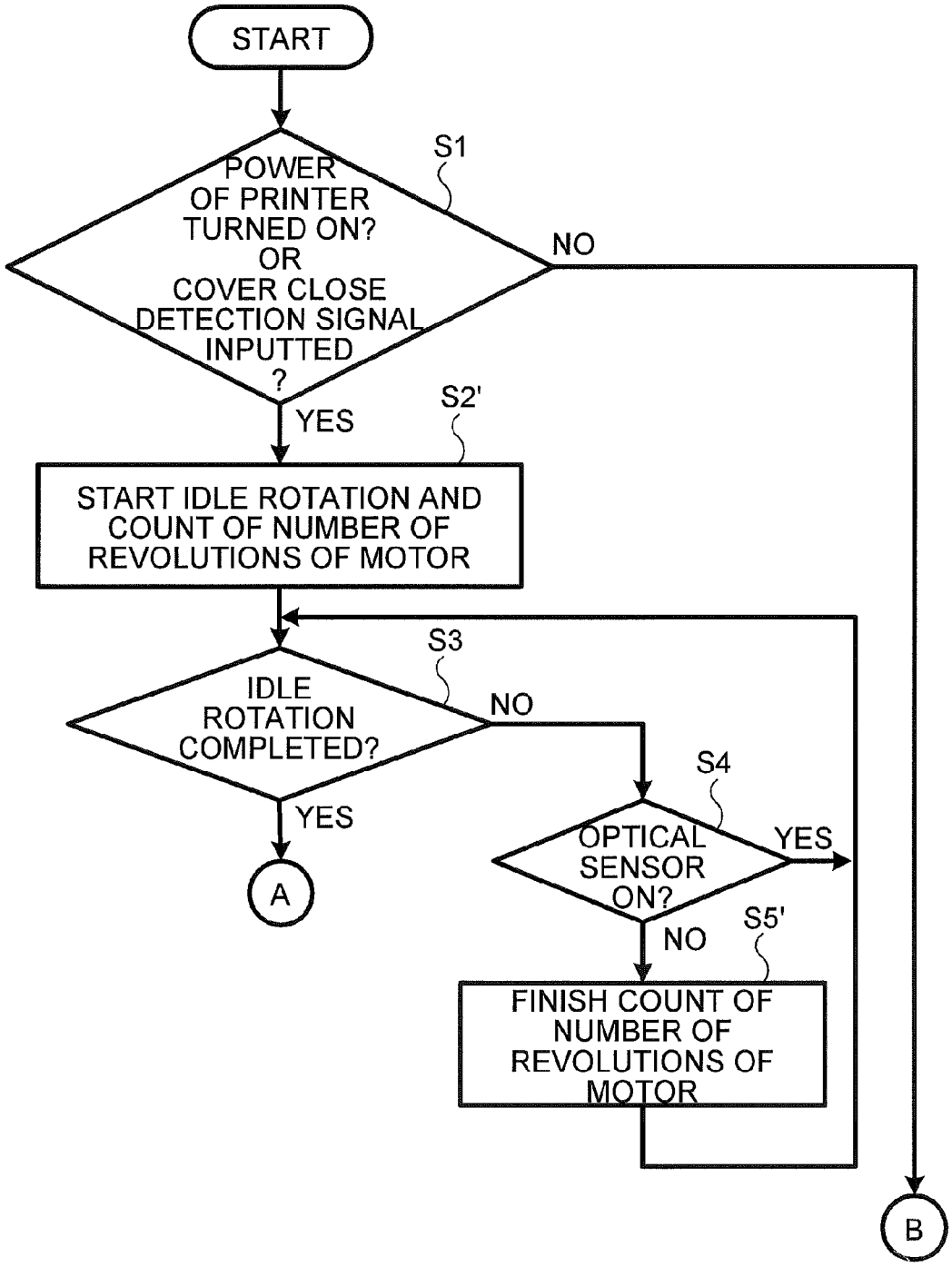
FIG. 17A is a flowchart of a cartridge condition and a cartridge type detection, according to yet another embodiment of the present invention, in which the condition and the type of an installed developer cartridge are detected by a rotational amount of a motor.
Figure 17B:
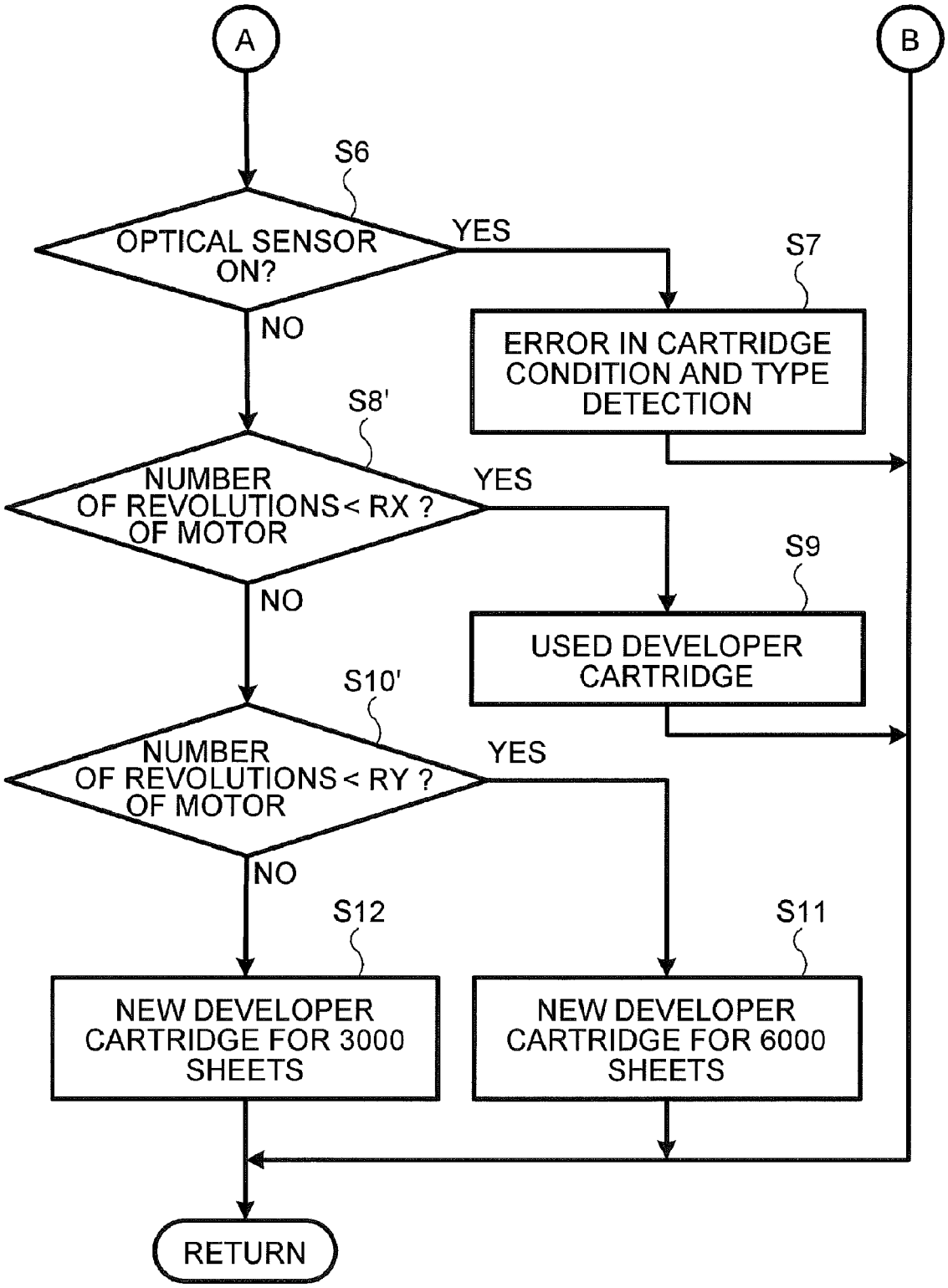
FIG. 17B is a continuation of the flowchart of FIG. 17A.

As illustrated, the type of the installed developer cartridge 28 may be detected based on the time elapsed between when the driving of the drive device 110 starts and when the optical sensor 121 changes to an off state. Nevertheless, in an embodiment of the invention, the type of the installed developer cartridge 28 may be detected based on the amount of drive of the drive device 110 required between the time drive device 110 starts and the time when the optical sensor 121 changes to an off state. This may be detected by the optical sensor 121. In this case, a revolution per minute ("RPM") detection sensor may be positioned in the drive device 110, and the controller 124 may count the number of revolutions during the extension portion moving time α or β. In another embodiment of the invention, the extension portion moving time α, β of the table 208 shown in FIG. 13B may be changed to the number of revolutions of the motor Rα and Rβ counted during the extension portion moving time α and β, and the control may be performed in accordance with the flowchart of FIGS. 17A and 17B. In the flowchart of FIGS. 17A and 17B, the extension portion moving time of FIGS. 15A and 15B may be changed to the number of revolutions of the motor. For example, S2', S5', S8', and S10' of FIGS. 17A and 17B, at which processing to be performed, may be different from S2, S5, S8, and S10 of FIGS. 15A and 15B.

Specifically, in another embodiment of the invention, at S2', the controller 124 may start the idle rotation and the count of the number of revolutions of the motor. At S5', the controller 124 may stop the count of the number of revolutions of the motor. At S8', it may be determined whether the number of revolutions of the motor actually obtained during the time between S2' and S5' is less than the number of revolutions of the motor RX which may be predetermined to be obtained during the time X of the threshold value. At S10', it may be determined whether the number of revolutions obtained during the time between S2' and S5' is less than the number of revolutions of the motor RY which may be predetermined to be obtained during the time Y of the threshold value. By performing the processing of S2', S5', S8' and S10', the cartridge condition and the cartridge type detection also may be accurately performed.

When the detection of the extension portion moving time of FIGS. 15A and 15B, or the detection of the number of revolutions of the motor of FIGS. 17A and 17B may be performed, an accumulated value of the time elapsed to move the extension portion 92, 102 or an accumulated value of the number of revolutions of the motor may be periodically stored in a nonvolatile memory during the detection. Thus, if the power of the laser printer 1 is turned off during the idle rotation, the value stored in the memory may be referred to when the power of the laser printer 1 is turned on next time. Accordingly, in an embodiment of the invention, an appropriate control may be performed in consideration of the actions of the engagement gear 80 and the rotational body 90 before the power of the laser printer 1 is turned off.

In an embodiment of the invention, detection arm 122 may be supported by a shaft at substantially the middle portion, such that detection arm 122 may be swingable. For example, one end of a detection arm may be supported by a shaft. In this case, the other end of the detection arm may be positioned at a position at which the detection arm may contact a rotational arm, and a portion between the one end and the other end of the detection arm may be positioned between a light emitting portion and a light receiving portion of an optical sensor.

In an embodiment of the invention, the toothed portion 82*a*, 104, and the transmission gear 67 may engage by contacting the extension portion 92, 102, and the detection arm 122, with each other, when the developer cartridge 28 is attached to the body casing 2. The extension portion 92, 102 may contact any portion of the body casing 2. Nevertheless, in another embodiment of the invention, a parts count may be restricted if the extension portion 92, 102 contacts the detection arm 122.

In an embodiment of the invention, optical sensor 121 may be used as an example of the detector. For example, a distance sensor may be configured to detect a position of an end portion of a detection arm, such as an ultrasonic sensor, and an optical sensor may be used as an example of the detector. In another embodiment of the invention, a leaf spring may be provided so as to contact a detection arm and a strain gauge may be provided to the leaf spring, such that the swing of the detection arm may be detected. Further, in an embodiment of the invention, the coil spring 123 that urges the detection arm 122 may be used as an example of an elastic member. Nevertheless, in another embodiment of the invention, a torsion spring or a leaf spring may be used instead of the coil spring 123.

The engaging groove 81*a* of the engagement gear 80, and the engaging portion 72*a* of the second support shaft portion 72, may be examples of the regulating member. For example, an engagement gear may comprise an engaging portion deformable in a diameter direction of the engagement gear, and a second support shaft portion may have a groove with which the engaging portion of the engagement gear may engage. The first contact surface of the engaging portion 72*a* may have a substantially arced shape.

In an embodiment of the invention, the transmission system in the first developer cartridge 28 may be implemented by two components of the engagement gear 80 and the rotational body 90 and the transmission system in the second developer cartridge 28 may be implemented by a single component of the gear rotational body 100. In another embodiment of the invention, the transmission system in the first developer cartridge 28 may be implemented by a single component and the transmission system in the second developer cartridge 28 may be implemented by two components.

Referring to FIG. 17, in an embodiment of the invention, the RPM detection sensor may be positioned such that the drive device 110 and the controller 124 may count the number of revolutions of the motor Rα, Rβ. The RPM detection sensor may be provided at an intermediate gear between a drive device and an extension portion, and the controller 124 may be configured to count the number of revolutions of the motor Rα, Rβ.

In the states shown in FIGS. 10B to 10D, the extension portion 92 of the rotational body 90 may contact and slide over the contact wall 74*a*. Nevertheless, in another embodiment of the invention, the extension portion 92 also may contact and slide over the contact wall 74*a* in the states shown in FIGS. 10A and 10E. A portion that contacts and slides over a rotational body may be provided at a position other than an opening through which the extension portion 92 passes to the outside, such that extension portion 92 may be maintained at the predetermined position, e.g., the position shown in FIG. 10C, instead of the contact wall 74*a*.

Figure 18A:
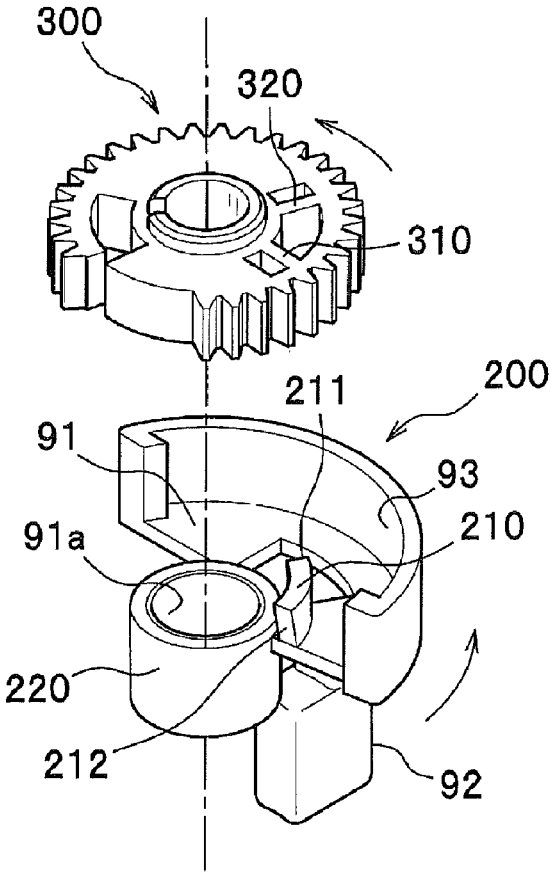
FIG. 18A is an enlarged, perspective view of right sides of an engagement gear and a rotational body, according to yet another embodiment of the present invention.
Figure 18B:
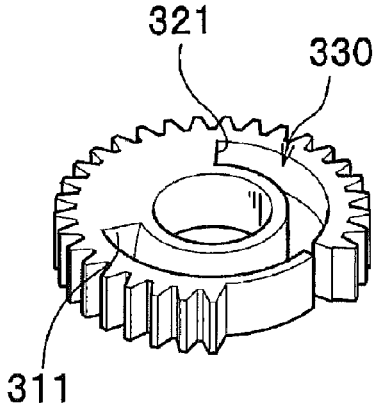
FIG. 18B is a perspective view of a left side of the engagement gear of FIG. 18A.
Figure 18C:
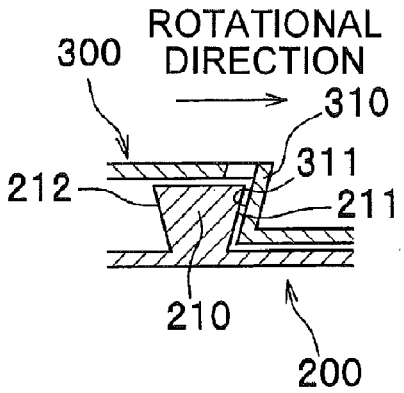
FIG. 18C is a sectional view of the engagement gear and the rotational body of FIG. 18A, illustrating a state where a leading surface of a projection of the rotational body contacts a first engaging surface of a first regulating rib of the engagement gear when viewed from a direction perpendicular to a rotational axis of the rotational body of FIG. 18A.
Figure 18D:
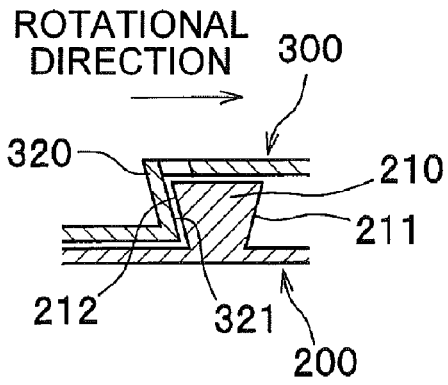
FIG. 18D is a sectional view of the engagement gear and rotational body of FIG. 18A, illustrating a state where a trailing surface of the projection of the rotational body contacts a second engaging surface of a second regulating rib of the engagement gear when viewed from the direction perpendicular to the rotational axis of the rotational body of FIG. 18A.

Referring to FIG. 18A, in an embodiment of the invention, a rotational body 200 may comprise a projection 210 and a cylindrical portion 220, which may differ from the rotational body 90 of FIG. 4. In addition, rotational body 200 may comprise an opening 91*a*, an extension portion 92, a sector-shape rotational frame 91 and a circular rib 93, which may be similar to those described in relation to the rotational body 90 of FIG. 4. The projection 210 may be an arc-shape rib that may extend along the opening 91*a*. The projection 210 may comprises a section shape when viewed from a direction perpendicular to a rotational axis of the rotational body 200. Referring to FIGS. 18C and 18D, for example, the projection 210 may comprise a leading surface 211 and a trailing surface 212, with respect to a rotational direction of the rotational body 200. The leading surface 211 of the projection 210 may be inclined in a rotational direction of an engagement gear 300. The trailing surface 212 of the projection 210 may be inclined in a direction opposite to the rotational direction of the engagement gear 300.

Referring again to FIG. 4C, the engagement gear 300 may comprise a first regulating rib 310 and a second regulating rib 320, which may be positioned at substantially the same positions where the first regulating rib 84 and the second regulating rib 85 of the engagement gear 80 may be positioned in the engagement gear 80. The first regulating rib 310 and the second regulating rib 320 may be inclined such that they extend along the leading and trailing faces 211, 212 of the projection 210, respectively. Referring to FIG. 18B, the first regulating rib 310 may comprise a first engaging surface 311, and the second regulating rib 320 may comprise a second engaging surface 321.

Referring to FIG. 18C, the first engaging surface 311 of the first regulating rib 310 may be inclined in a direction opposite to the rotational direction of the engagement gear 300, toward the rotational body 200. Referring to FIG. 18D, the second engaging surface 321 of the second regulating rib 320 may be inclined in the rotational direction of the engagement gear 300, toward the rotational body 200. Thus, when the projection 210 and the first regulating rib 310 are contacted with each other and when the projection 210 and the second regulating rib 320 are contacted with each other, a force may be applied on the rotational body 200 and the engagement gear 300, such that the rotational body 200 and the engagement gear 300 push each other. Accordingly, the rotational body 200 and the engagement gear 300 securely may engage, and may rotate integrally.

The cylinder portion 220 of the rotational body 200 may comprise a wall which may have a thickness greater than the thickness plate-like rotational frame 91. For example, the cylinder portion 220 may extend from the rotational frame 91 in an extending direction of the extension portion 92. Therefore, in the states shown in FIGS. 10B and 10C, the inclination of the cylindrical portion 220, with respect to the second support shaft portion 72 of the cover member 70, may be restricted and a frictional force may be applied to the extension portion 92 from the contact wall 74*a*.

Figure 19A:
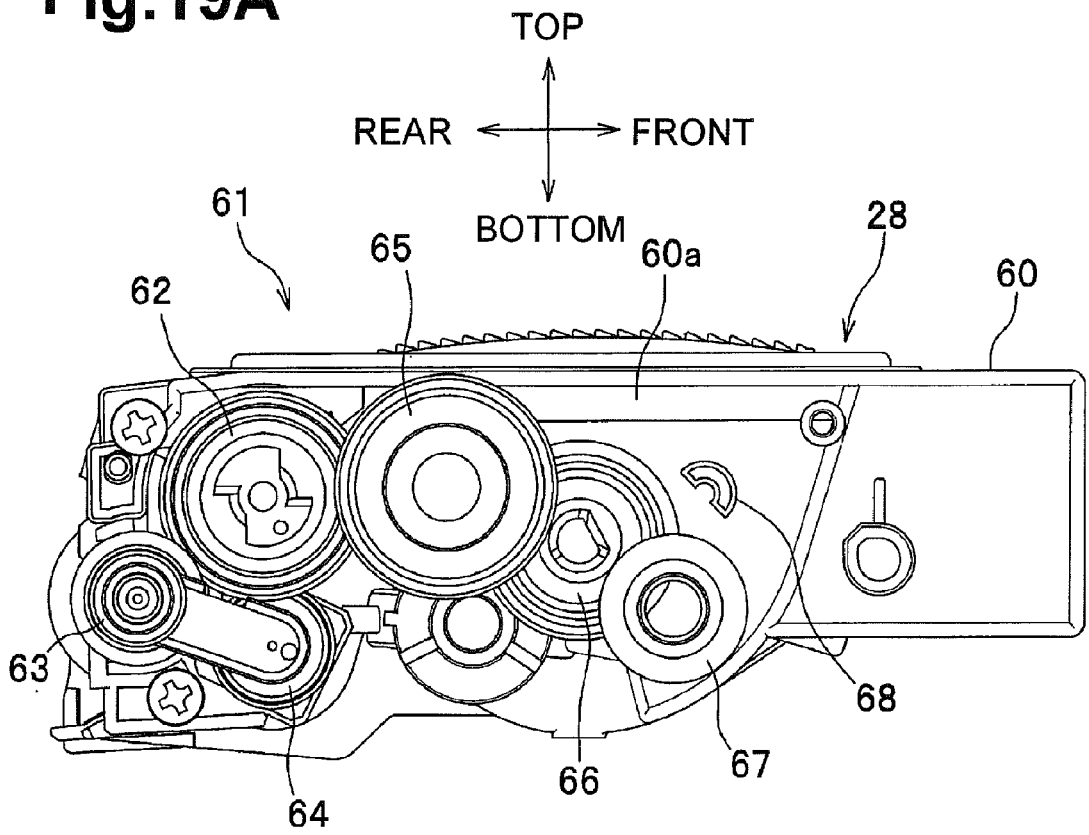
FIG. 19A is a left side sectional view of a cartridge body of a developer cartridge including a retainer at its left side surface, according to still yet a further embodiment of the present invention.

Referring to FIG. 18B, the engagement gear 300 comprises a regulating groove 330 at its opposite side, such that the engagement gear 300 and the rotational body 200 may not be misassembled. Further, the hook-shaped engaging portion 72*a* may retain the rotational body 90 and the engagement gear 80, such that the rotational body 90 and the engagement gear 80 may not become removed from the second support shaft portion 72. Referring to FIG. 19A, a cartridge body 60 may comprise a retainer 68, which may assist in the retaining of the rotational body 90 and the engagement gear 80. The retainer 68 may protrude leftward from a left surface 60*a* of the cartridge body 60.

Figure 19B:
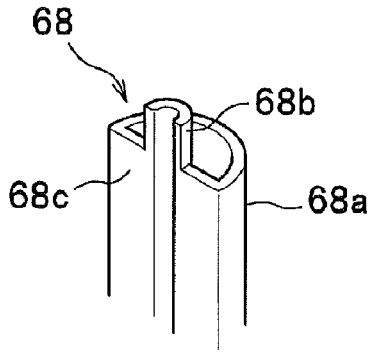
FIG. 19B is a perspective view of the retainer of FIG. 19A.
Figure 19C:
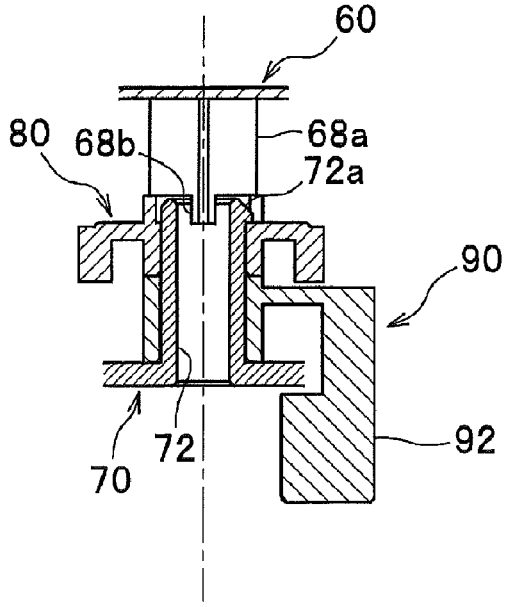
FIG. 19C is an enlarged, cross-sectional view of the retainer of FIG. 19A, the engagement gear, the rotational body, and the cover member illustrating a relationship therebetween.

For example, referring to FIG. 19B, the retainer 68 may comprise a larger-diameter portion 68*a* having a semicircular cylindrical shape, and a smaller-diameter portion 68*b* having a semicircular cylindrical shape, and a connection portion 68*c*. The smaller-diameter portion 68*b* may be coaxial with the larger-diameter portion 68*a* and may comprise a diameter smaller than that of the larger-diameter portion 68*a*. The connection portion 68*c* may connect edges of the larger-diameter portion 68*a* and the smaller-diameter portion 68*c* to each other. The smaller-diameter portion 68*b* may protrude from the larger-diameter portion 68*a*. Referring to FIG. 19C, a tip portion of the smaller-diameter portion 68*b* may be inserted into the second support shaft portion 72, and an end of the larger-diameter portion 68*a* may contact an end of the cylindrical portion 81 of the engagement gear 80, when the cover member 70 is attached to the cartridge body 60. By doing so, the engagement gear 80 may be securely retained at its position even if the engagement bear 80 and the engaging portion 72*a* tend to disengage from each other.

A strong force may be applied to the extension portion 92 toward the inside in the diameter direction of the second support shaft portion 72, and the center portion of the rotational body 90 may move in a direction that is the same as direction in which the rotational body 90 disengages from the second support shaft portion 72. In addition, the retainer 68, which may be provided to the cartridge body 60, may contact the second support shaft portion 72 from the inside, such that cover member 70 may warp toward the inside by a reduced amount. This may increase positional accuracy of the engagement gear 80 and the rotational body 90 with respect to the cartridge body 60.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An image forming apparatus comprising:

a cartridge configured to be removably attached to a main body, wherein the cartridge is configured to be in one of a new state or a used state, the cartridge comprising:

a rotational body positioned within the cartridge, and comprising an extension portion which is positioned offset from a center of the rotational body and configured to protrude outward from the rotational body in an axial direction, wherein the rotational body and the extension portion are configured to selectively be positioned in one of a first state and a second state;

an engagement gear positioned within the cartridge, the engagement gear comprises a first engaging portion and a center axis aligned with a center axis of the rotational body, and is configured to selectively rotate, and the rotational body further comprises a second engaging portion, and wherein the engagement gear and the rotational body are configured to selectively be positioned in one of a first gear state in which the second engaging portion and the first engaging portion are separated from each other, and a second gear state in which the second engaging portion engages the first engaging portion;

a transmission gear configured to transmit a rotational force to the engagement gear, wherein the engagement gear further comprises:

a toothed portion positioned at a first portion of a peripheral surface of the engagement gear; and a toothless portion positioned at a second portion of the peripheral surface of the engagement gear; and a regulating member configured to maintain the toothless portion and the transmission gear in a position in which they face each other, until a predetermined amount of force is applied to the engagement gear, the regulating member comprising:

an engaging portion positioned on a shaft portion which is configured to rotatably support the engagement gear, wherein the engaging portion is deformable in a diameter direction of the shaft portion; and an engaging groove formed in the engagement gear, wherein the engaging portion is configured to engage the engaging groove; and a device body comprising the main body, the main body comprising:

a driving member configured to rotate the rotational body;

a detecting unit configured to detect a movement of the extension portion between the first state to the second state; and a determining unit configured to receive a signal from the detecting unit when the extension portion moves between the first state and the second state, wherein the determining unit calculates an elapsed time between when the driving member starts driving and when the determining unit receives the signal from the detecting unit, wherein the determining unit is configured to determine whether the cartridge is in the new state or the used state, and to determine a type of the cartridge, based on the elapsed time.

2. An image forming apparatus comprising:

a cartridge configured to be removably attached to a main body, wherein the cartridge is configured to be in one of a new state or a used state, the cartridge comprising:

a rotational body positioned within the cartridge, and comprising an extension portion which is positioned offset from a center of the rotational body and configured to protrude outward from the rotational body in an axial direction, wherein the rotational body and the extension portion are configured to selectively be positioned in one of a first state and a second state;

an engagement gear positioned within the cartridge, the engagement gear comprises a first engaging portion and a center axis aligned with a center axis of the rotational body, and is configured to selectively rotate, and the rotational body further comprises a second engaging portion, and wherein the engagement gear and the rotational body are configured to selectively be positioned in one of a first gear state in which the second engaging portion and the first engaging portion are separated from each other, and a second gear state in which the second engaging portion engages the first engaging portion;

a transmission gear configured to transmit a rotational force to the engagement gear, wherein the engagement gear further comprises:

a toothed portion positioned at a first portion of a peripheral surface of the engagement gear; and a toothless portion positioned at a second portion of the peripheral surface of the engagement gear; and a regulating member configured to maintain the toothless portion and the transmission gear in a position in which they face each other, until a predetermined amount of force is applied to the engagement gear, the regulating member comprising:

an engaging portion positioned on a shaft portion which is configured to rotatably support the engagement gear, wherein the engaging portion is deformable in a diameter direction of the shaft portion; and an engaging groove formed in the engagement gear, wherein the engaging portion is configured to engage the engaging groove, and wherein the engaging portion comprises:

a first contact surface which is inclined with respect to the diameter direction of the shaft portion; and a second contact surface which extends in the diameter direction of the shaft portion, wherein the first contact surface and the second contact surface contact a wall of the engaging groove in a rotational direction of the engagement gear, such that the engagement gear is configured to rotate in a single direction only; and a device body comprising the main body, the main body comprising:

a driving member configured to rotate the rotational body;

a detecting unit configured to detect a movement of the extension portion between the first state to the second state; and a determining unit configured to receive a signal from the detecting unit when the extension portion moves between the first state and the second state, wherein the determining unit calculates an elapsed time between when the driving member starts driving and when the determining unit receives the signal from the detecting unit, wherein the determining unit is configured to determine whether the cartridge is in the new state or the used state, and to determine a type of the cartridge, based on the elapsed time.

3. The image forming apparatus of claim 2, wherein the shaft portion comprises a support portion configured to support the engaging portion when engagement gear applies a force to the engaging portion via the second contact surface.

4. The image forming apparatus of claim 1, wherein the transmission gear comprises a reduction gear configured to reduce a rotational speed of the engagement gear.

5. The image forming apparatus of claim 1, wherein the cartridge further comprises:

an inner housing configured to store a developing agent; and a cover member configured to be attached to the inner housing, wherein the engagement gear and the rotational body are positioned on the cover member.

6. An image forming apparatus comprising:

a cartridge configured to be removably attached to a main body, wherein the cartridge is configured to be in one of a new state or a used state, the cartridge comprising:

a rotational body positioned within the cartridge, and comprising an extension portion which is positioned offset from a center of the rotational body and configured to protrude outward from the rotational body in an axial direction, wherein the rotational body and the extension portion are configured to selectively be positioned in one of a first state and a second state; and an engagement gear positioned within the cartridge, the engagement gear comprises a first engaging portion and a center axis aligned with a center axis of the rotational body, and is configured to selectively rotate, and the rotational body further comprises a second engaging portion, and wherein the engagement gear and the rotational body configured to selectively be positioned in one of a first gear state in which the second engaging portion and the first engaging portion are separated from each other, and a second gear state in which the second engaging portion engages the first engaging portion, and wherein the first engaging portion comprises one of a protrusion and a groove, and the second engaging portion comprises the other of the protrusion and the groove; and a device body comprising the main body, the main body comprising:

a driving member configured to rotate the rotational body;

a detecting unit configured to detect a movement of the extension portion between the first state to the second state; and a determining unit configured to receive a signal from the detecting unit when the extension portion moves between the first state and the second state, wherein the determining unit calculates an elapsed time between when the driving member starts driving and when the determining unit receives the signal from the detecting unit, wherein the determining unit is configured to determine whether the cartridge is in the new state or the used state, and to determine a type of the cartridge, based on the elapsed time.

7. The image forming apparatus of claim 6, wherein the detecting unit comprises:

an optical sensor comprising a light emitting portion and a light receiving portion; and a detection arm configured to swing with respect to the main body, wherein the extension portion is configured to contact the detection arm, and wherein when the extension portion contacts the detection arm, an amount of light transmitted between the light emitting portion and the light receiving portion is changed.

8. The cartridge of claim 1, wherein the rotational body is configured to rotate with the engagement gear when the engagement gear rotates and the engagement gear and the rotational body are in the second state.

* * * * *